US010559244B2

(12) United States Patent
Yang et al.

(10) Patent No.: US 10,559,244 B2
(45) Date of Patent: Feb. 11, 2020

(54) ELECTRONIC APPARATUS, DISPLAY DRIVER AND METHOD FOR GENERATING DISPLAY DATA OF DISPLAY PANEL

(71) Applicant: Novatek Microelectronics Corp., Hsinchu (TW)

(72) Inventors: Hsueh-Yen Yang, Taoyuan (TW); Sheng-Tien Cho, Hsinchu (TW); Ching-Pei Cheng, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 91 days.

(21) Appl. No.: 15/806,327

(22) Filed: Nov. 8, 2017

(65) Prior Publication Data

US 2018/0130395 A1 May 10, 2018

Related U.S. Application Data

(60) Provisional application No. 62/418,811, filed on Nov. 8, 2016.

(51) Int. Cl.
*G09G 3/20* (2006.01)

(52) U.S. Cl.
CPC ... *G09G 3/2003* (2013.01); *G09G 2300/0443* (2013.01); *G09G 2340/0457* (2013.01); *G09G 2360/18* (2013.01)

(58) Field of Classification Search
CPC ..... G09G 2340/0457
See application file for complete search history.

(56) References Cited

U.S. PATENT DOCUMENTS 6,243,070 B1 * 6/2001 Hill ..... G02F 1/133514 345/589
8,031,205 B2 10/2011 Brown Elliott et al.
(Continued)

FOREIGN PATENT DOCUMENTS

CN 101620844 1/2010
CN 102142223 8/2011
(Continued)

OTHER PUBLICATIONS

Sheng-Tien Cho et al., "Image processing method and related apparatus", Unpublished U.S. Appl. No. 15/673,432, filed Aug. 10, 2017, The specification, claims, and the drawings of the unpublished pending U.S. application have been stored in the Image File Wrapper (IFW) system.
(Continued)

*Primary Examiner* — Robin J Mishler
(74) *Attorney, Agent, or Firm* — JCIPRNET

(57) ABSTRACT

A display driver adapted to drive a display panel is provided. The display panel includes a pixel column direction and a pixel row direction. The display driver includes an image data processor unit. The image data processor unit performs a two-dimensional subpixel rendering operation on an input image data to generate an output image data. The display driver drives the display panel according to the output image data. The two-dimensional subpixel rendering operation includes a first one-dimensional subpixel rendering operation in a first direction and a second one-dimensional subpixel rendering operation in a second direction. The first direction is one of the pixel column direction and the pixel row direction, and the second direction is another one of the pixel column direction and the pixel row direction.

27 Claims, 19 Drawing Sheets

(56) References Cited

U.S. PATENT DOCUMENTS

| | | | |
|---|---|---|---|
| 9,035,979 | B2 | 5/2015 | Kabe et al. |
| 9,640,131 | B2 | 5/2017 | Croxford |
| 2010/0277498 | A1 | 11/2010 | Elliott et al. |
| 2011/0181635 | A1 | 7/2011 | Kabe et al. |
| 2015/0221268 | A1 | 8/2015 | Kabe et al. |
| 2015/0228248 | A1 | 8/2015 | Croxford |
| 2016/0260401 | A1 | 9/2016 | Sakaigawa |
| 2017/0193932 | A1 | 7/2017 | Kabe et al. |

FOREIGN PATENT DOCUMENTS

| | | |
|---|---|---|
| TW | 201532029 | 8/2015 |
| TW | 201636984 | 10/2016 |

OTHER PUBLICATIONS

"Office Action of Taiwan Counterpart Application," dated May 11, 2018, p. 1-p. 4.

* cited by examiner

ELECTRONIC APPARATUS, DISPLAY DRIVER AND METHOD FOR GENERATING DISPLAY DATA OF DISPLAY PANEL

CROSS-REFERENCE TO RELATED APPLICATION

This application claims the priority benefit of U.S. provisional application Ser. No. 62/418,811, filed on Nov. 8, 2016. The entirety of the above-mentioned patent application is hereby incorporated by reference herein and made a part of this specification.

BACKGROUND OF THE INVENTION

1. Field of the Invention

The invention relates an electronic apparatus, a display driver and a method for generating a display data of a display panel.

2. Description of Related Art

With blooming development in display technology, market demands for performance requirements of a display panel are advancements in high resolution, high brightness and low-power consumption. However, with improved resolution of the display panel, because an amount of subpixels on the display panel will also increase for displaying in high resolution, the manufacturing cost is also increased accordingly. In order to reduce the manufacturing cost of the display panel, a subpixel rendering method (SPR method) has been proposed. A display apparatus generally uses different arrangements and designs of the subpixels to formulate a proper algorithm so a resolution visible by human eye (i.e., a visual resolution) may be increased.

Besides, in comparison with a data quantity of pixel data not processed by the SPR method, the pixel data processed by the SPR method can provide a reduced data quantity, which is conducive to data transmission.

SUMMARY OF THE INVENTION

The invention is directed to an electronic apparatus, a display driver and a method for generating a display data of a display panel with a data processing including a two-dimensional subpixel rendering operation, which is capable reducing a data transmission amount.

The display driver of the invention is adapted to drive a display panel. The display panel includes a pixel column direction and a pixel row direction. The display driver includes an image data processor unit. The image data processor unit performs a two-dimensional subpixel rendering operation on an input image data to generate an output image data. The display driver drives the display panel according to the output image data. The two-dimensional subpixel rendering operation includes a first one-dimensional subpixel rendering operation in a first direction and a second one-dimensional subpixel rendering operation in a second direction. The first direction is one of the pixel column direction and the pixel row direction, and the second direction is another one of the pixel column direction and the pixel row direction.

In an embodiment of the invention, the two-dimensional subpixel rendering operation includes performing a first one-dimensional subpixel rendering operation in the first direction on the input image data to generate a rendered image data, and performing the second one-dimensional subpixel rendering operation in the second direction on the rendered image data to generate the output image data.

In an embodiment of the invention, the first one-dimensional subpixel rendering operation includes computing a subpixel data in a pixel data and at least one adjacent subpixel data in the first direction with identical color in the input image data according to a first set of diffusion ratios, so as to generate a subpixel data in a rendered pixel data in the rendered image data.

In an embodiment of the invention, the second one-dimensional subpixel rendering operation includes computing the subpixel data in the rendered pixel data and at least one adjacent subpixel data in the second direction with identical color in the rendered image data according to a second set of diffusion ratios, so as to generate a subpixel data in an output pixel data in the output image data.

In an embodiment of the invention, when a subpixel sampling rate of the first one-dimensional subpixel rendering operation is 2/3 and the first direction is the pixel column direction, with respect to a first pixel data corresponding to a middle row among three consecutive pixel data of the pixel column direction in the input image data, a first color subpixel data in the first pixel data is assigned as a first color component of a first rendered pixel data among two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

In an embodiment of the invention, when a subpixel sampling rate of the first one-dimensional subpixel rendering operation is 1/2 and the first direction is the pixel column direction, with respect to a first pixel data among two consecutive pixel data of the pixel column direction in the input image data, a first color subpixel data in the first pixel data is assigned as a first color component of a first rendered pixel data among two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

The method for generating the display data of the display panel of the invention includes: performing a first one-dimensional subpixel rendering operation in a first direction on an input image data to generate a rendered image data; and performing the second one-dimensional subpixel rendering operation in the second direction on the rendering image data to generate the output image data. The output image data is used for driving the display panel. The display panel includes a pixel column direction and a pixel row direction. The first direction is one of the pixel column direction of the display panel and the pixel row direction of the display panel and the second direction is another one of the pixel column direction of the display panel and the pixel row direction of the display panel.

In an embodiment of the invention, the first one-dimensional subpixel rendering operation includes computing a subpixel data in a pixel data and at least one adjacent subpixel data in the first direction with identical color in the input image data according to a first set of diffusion ratios, so as to generate a subpixel data in a rendered pixel data in the rendered image data.

In an embodiment of the invention, the second one-dimensional subpixel rendering operation includes computing the subpixel data in the rendered pixel data and at least one adjacent subpixel data in the second direction with identical color in the rendered image data according to a second set of diffusion ratios, so as to generate a subpixel data in an output pixel data in the output image data.

In an embodiment of the invention, when a subpixel sampling rate of the first one-dimensional subpixel rendering operation is 2/3 and the first direction is the pixel column direction, with respect to a first pixel data corresponding to a middle row among three consecutive pixel data of the pixel column direction in the input image data, a first color subpixel data in the first pixel data is assigned as a first color component of a first rendered pixel data among two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

In an embodiment of the invention, when a subpixel sampling rate of the first one-dimensional subpixel rendering operation is 1/2 and the first direction is the pixel column direction, with respect to a first pixel data among two consecutive pixel data of the pixel column direction in the input image data, a first color subpixel data in the first pixel data is assigned as a first color component of a first rendered pixel data among two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

The electronic apparatus of the invention includes a display panel, an image data processor unit, an image compression unit, a storage unit and an image decompression nit. The display panel includes a pixel column direction and a pixel row direction. The image data processor unit is configured to perform a two-dimensional subpixel rendering operation on a first image data to generate a second image data. The image compression unit is configured to compress the second image data to generate a third image data. The storage unit is configured to receive and store the third image data. The image decompression unit is configured to decompress the third image data to generate a fourth image data. The display panel is driven according to the fourth image data. The two-dimensional subpixel rendering operation includes a first one-dimensional subpixel rendering operation in a first direction and a second one-dimensional subpixel rendering operation in a second direction. The first direction is one of the pixel column direction and the pixel row direction, and the second direction is another one of the pixel column direction and the pixel row direction.

In an embodiment of the invention, the two-dimensional subpixel rendering operation includes performing the first one-dimensional subpixel rendering operation in the first direction on the first image data to generate a fifth image data, and performing the second one-dimensional subpixel rendering operation in the second direction on the fifth image data to generate the second image data.

In an embodiment of the invention, the first one-dimensional subpixel rendering operation includes computing a subpixel data in a pixel data and at least one adjacent subpixel data in the first direction with identical color in the first image data according to a first set of diffusion ratios, so as to generate a subpixel data in a rendered pixel data in the fifth image data.

In an embodiment of the invention, the second one-dimensional subpixel rendering operation includes computing the subpixel data in the rendered pixel data and at least one adjacent subpixel data in the second direction with identical color in the fifth image data according to a second set of diffusion ratios, so as to generate a subpixel data in a rendered pixel data in the second image data.

In an embodiment of the invention, when a subpixel sampling rate of the first one-dimensional subpixel rendering operation is 2/3 and the first direction is the pixel column direction, with respect to a first pixel data corresponding to a middle row among three consecutive pixel data of the pixel column direction in the first image data, a first color subpixel data in the first pixel data is assigned as a first color component of a first rendered pixel data among two consecutive rendered pixel data of the pixel column direction in the fifth image data according to a first color diffusion ratio, and a second color subpixel data in the first pixel data is assigned as a second color component of a second rendered pixel data among the two consecutive rendered pixel data according to a second color diffusion ratio.

In an embodiment of the invention, when a subpixel sampling rate of the first one-dimensional subpixel rendering operation is 1/2 and the first direction is the pixel column direction, with respect to a first pixel data among two consecutive pixel data of the pixel column direction in the first image data, a first color subpixel data in the first pixel data is assigned as a first color component of a first rendered pixel data among two consecutive rendered pixel data of the pixel column direction in the fifth image data according to a first color diffusion ratio, and a second color subpixel data in the first pixel data is assigned as a second color component of a second rendered pixel data among the two consecutive rendered pixel data according to a second color diffusion ratio.

In an embodiment of the invention, the image data processor unit, the image compression unit, the storage unit and the image decompression unit are disposed in a display driver of the electronic apparatus. The display driver is coupled to the display panel, and configured to drive the display panel according to the fourth image data.

In an embodiment of the invention, the display driver further includes a first subpixel rendering inverse operation unit and a first computation unit. The first subpixel rendering inverse operation unit is configured to perform a two-dimensional subpixel rendering inverse operation on the second image data to generate a first inverse image data. The first computation unit is configured to calculate a difference between the first image data and the first inverse image data.

In an embodiment of the invention, the image compression unit performs a data compression on the difference between the first image data and the first inverse image data to generate an image error data to be outputted to the storage unit.

In an embodiment of the invention, the storage unit is further configured to receive and store the image error data. The image decompression unit decompresses the image error data to generate a sixth image data.

In an embodiment of the invention, the display driver further includes a second subpixel rendering inverse operation unit. The second subpixel rendering inverse operation unit is configured to perform the two-dimensional subpixel rendering inverse operation on the fourth image data to generate a second inverse image data. The second computation unit is configured to combine the sixth image data and the second inverse image data to generate a seventh image data. The display driver drives the display panel according to the seventh image data.

In an embodiment of the invention, the image data processor unit and the image compression unit are disposed in a processor of the electronic apparatus. The storage unit and the image decompression unit are disposed in a display driver of the electronic apparatus. The display driver is coupled to the processor and the display panel. The display driver is configured to receive the third image data from the processor and drive the display panel according to the fourth image data.

In an embodiment of the invention, the processor further includes a first subpixel rendering inverse operation unit and a first computation unit. The first subpixel rendering inverse operation unit is configured to perform a two-dimensional subpixel rendering inverse operation on the second image data to generate a first inverse image data. The first computation unit is configured to calculate a difference between the first image data and the first inverse image data.

In an embodiment of the invention, the image compression unit of the processor performs a data compression on the difference between the first image data and the first inverse image data to generate an image error data to be outputted to the storage unit of the display driver.

In an embodiment of the invention, the storage unit of the display driver is further configured to receive and store the image error data. The image decompression unit of the display driver decompresses the image error data to generate a sixth image data.

In an embodiment of the invention, the display driver further includes a second subpixel rendering inverse operation unit and a second computation unit. The second subpixel rendering inverse operation unit is configured to perform the two-dimensional subpixel rendering inverse operation on the fourth image data to generate a second inverse image data. The second computation unit is configured to combine the sixth image data and the second inverse image data to generate a seventh image data. The display driver drives the display panel according to the seventh image data.

Based on the above, according to the exemplary embodiments of the invention, with the two-dimensional subpixel rendering operation performed by the image data processor unit on the input image data to generate the output image data, the data transmission amount of the image data in the device or between devices may be reduced.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
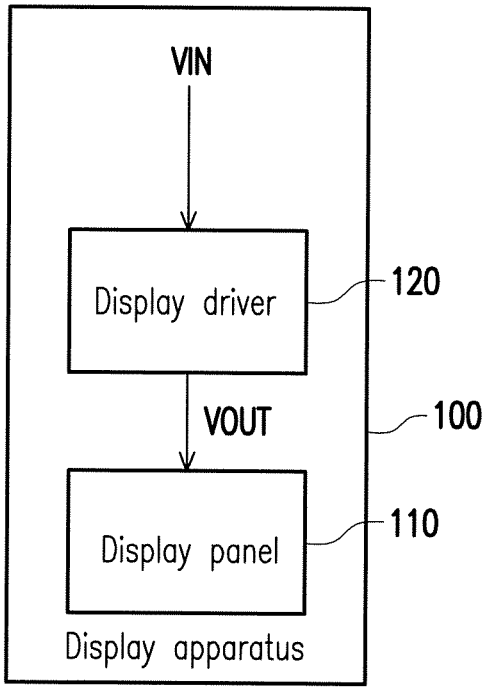
FIG. 1 is a schematic diagram illustrating a display apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram illustrating a display apparatus according to an embodiment of the invention. With reference to FIG. 1, a display apparatus 100 of the present embodiment includes a display panel 110 and a display driver 120. The display panel 110 is coupled to the display driver 120. In the present embodiment, the display driver 120 includes, for example, an image data processor unit, which is configured to perform a two-dimensional subpixel rendering operation on an input image data VIN to generate an output image data VOUT. Further, the display driver 120 drives the display panel 110 according to the output image data VOUT. In the present embodiment, the display panel 110 is, for example, a display panel such as a liquid crystal display panel or an organic light-emitting diode panel, but the type of the display panel 110 is not particularly limited in the invention.

Figure 2C:
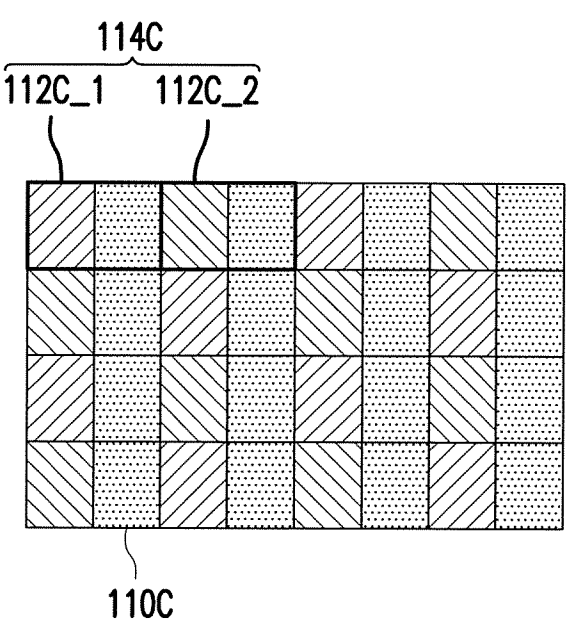
FIG. 2A to FIG. 2C are schematic diagrams illustrating pixel arrangements of a display panel in the embodiment of FIG. 1.
Figure 2B:
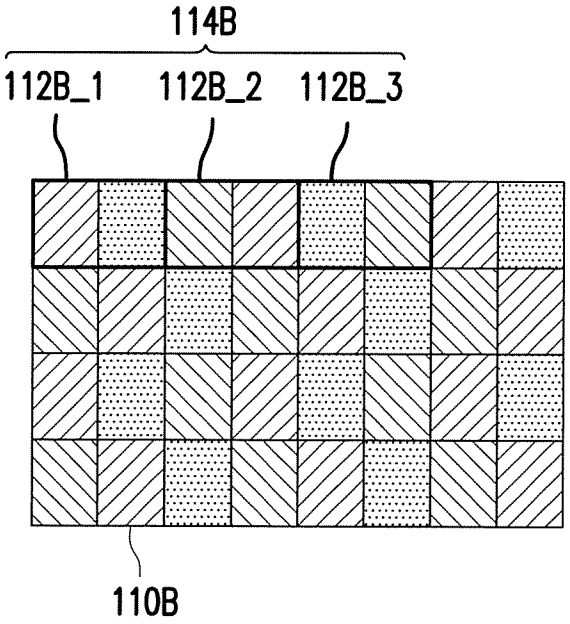
Figure 2A:
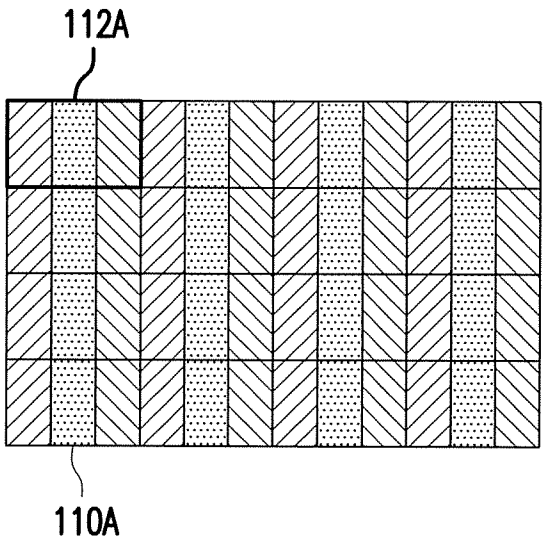

FIG. 2A to FIG. 2C are schematic diagrams illustrating pixel arrangements of a display panel in the embodiment of FIG. 1. A display panel 110A illustrated in FIG. 2A is, for example, a full color display panel. Each pixel 112A in the display panel 110A includes subpixels in three colors, which are red, green and blue. Herein, each pixel is a pixel repeating unit, repeatedly arranged to form the display panel 110A. A display panel 110B illustrated in FIG. 2B is, for example, an exemplary embodiment of a subpixel rendering (SPR) display panel. The display panel 110B includes a pixel repeating unit 114B. The pixel repeating unit 114B is repeatedly arranged to form the display panel 110B. The pixel repeating unit 114B includes a pixel 112B_1, a pixel 112B_2 and a pixel 112B_3. The pixel 112B_1 includes a red subpixel and a green subpixel. The pixel 112B_2 includes a blue subpixel and a red subpixel. The pixel 112B_3 includes a green subpixel and a blue subpixel. A display panel 110C illustrated in FIG. 2C is, for example, another exemplary embodiment of the SPR display panel. The display panel 110C includes a pixel repeating unit 114C. The pixel repeating unit 114C is repeatedly arranged to form the display panel 110C. The pixel repeating unit 114C includes a pixel 112C_1 and a pixel 112C_2. The pixel 112C_1 includes a red subpixel and a green subpixel. The pixel 112C_2 includes a blue subpixel and a green subpixel.

As described above, in the exemplary embodiments of the invention, the display driver 120 can be used for driving the full color display panel or the SPR display panel. Further, in the exemplary embodiments of the invention, the type of the SPR display panel is not limited by those illustrated in FIG. 2B and FIG. 2C.

Figure 3A:
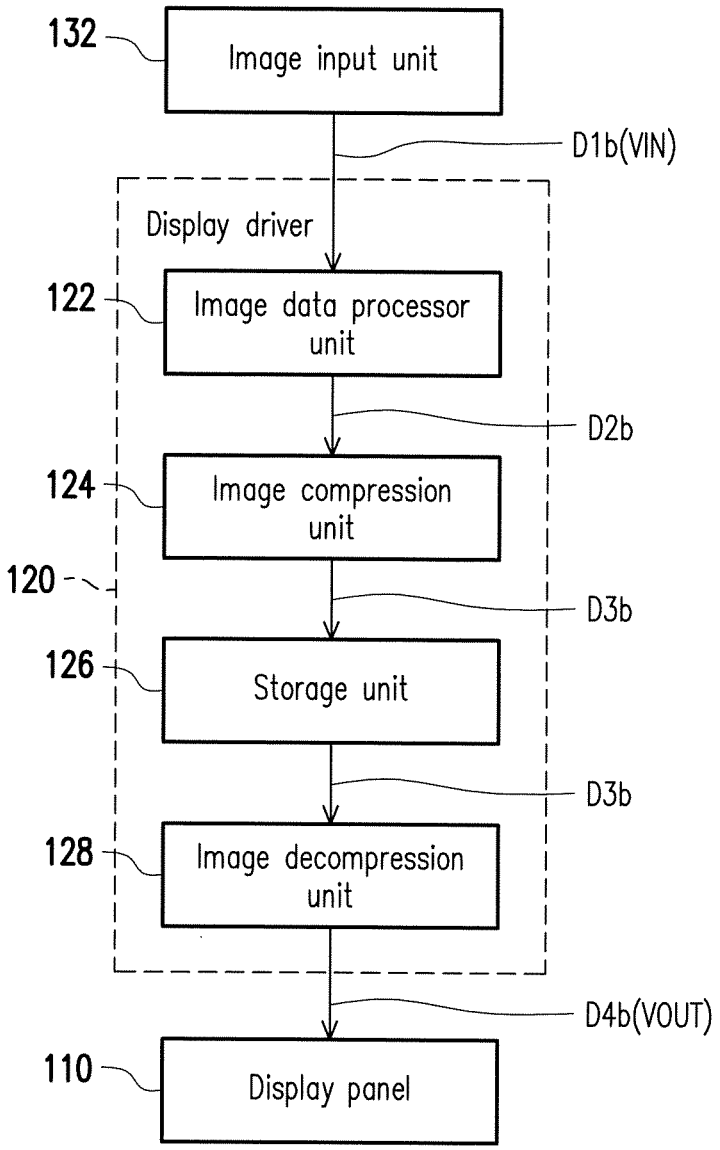
FIG. 3A is a schematic diagram of a display driver in the embodiment of FIG. 1.
Figure 3B:
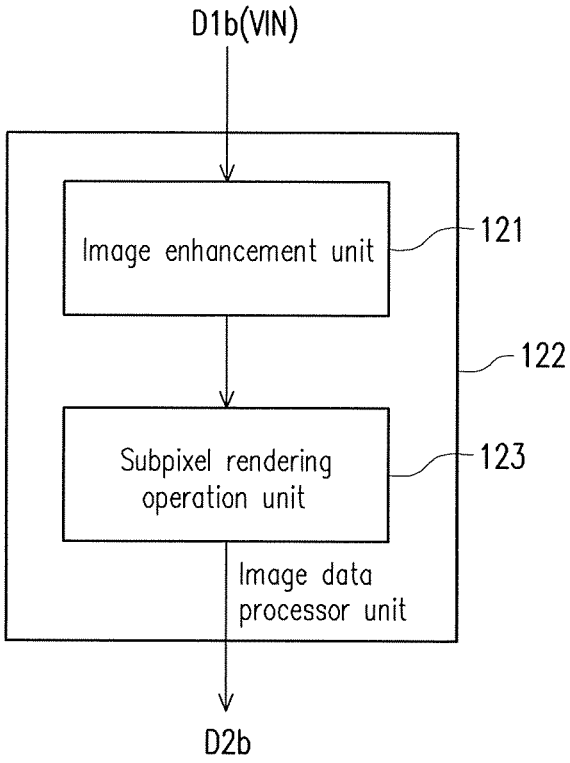
FIG. 3B is a schematic diagram of an image data processor unit in the embodiment of FIG. 3A.

FIG. 3A is a schematic diagram of the display driver 120 in the embodiment of FIG. 1. FIG. 3B is a schematic diagram of an image data processor unit in the embodiment of FIG. 3A. With reference to FIG. 3A and FIG. 3B, the display driver 120 of the present embodiment includes an image data processor unit 122, an image compression unit 124, a storage unit 126 and an image decompression unit 128. The image data processor unit 122, the image compression unit 124, the storage unit 126 and the image decompression unit 128 are disposed in the display driver 120 of the display apparatus 100. In the present embodiment, an image input unit 132 is, for example, an image source outside the display driver 120, which is configured to output a first image data D1*b* to the image data processor unit 122. Also, the first image data D1*b* is used as the input image data VIN and inputted to the image data processor unit 122. In an embodiment, for driving a small or medium size panel, the display driver 120 is, for example, an integrated driving chip, which includes a timing controller and a source driver. The image data processor unit 122 is, for example, disposed in the timing controller. In an embodiment, for driving a large size panel, the display driver 120 includes, for example, a timing controller. The image data processor unit 122 is, for example, disposed in the timing controller.

In the present embodiment, the image data processor unit 122 includes an image enhancement unit 121 and a subpixel rendering operation unit 123. The image enhancement unit 121 receives the first image data D1*b*. In the present embodiment, a data quantity of the first image data D1*b* includes, for example, a frame data of K bits. The image enhancement unit 121 is, for example, configured to enhance boundary regions between object and object or between object and background in images so as to bring out the boundary regions so they can be easily determined thereby improving an image quality. The image enhancement unit 121 may also include a related image processing for adjusting image color or luminance. In the present embodiment, the subpixel rendering operation unit 123 receives the first image data D1*b* processed by the image enhancement unit 121. The subpixel rendering operation unit 123 is configured to perform the two-dimensional subpixel rendering operation on the first image data D1*b* to generate a second image data D2*b*. The two-dimensional subpixel rendering operation may include a one-dimensional subpixel rendering operation performed twice in different directions. In the present embodiment, if the two-dimensional subpixel rendering operation includes the one-dimensional subpixel rendering operation performed twice in different directions with both subpixel sampling rates being 2/3, a data quantity of the second image D2*b* is (4/9)K bits. In an embodiment, it is also possible that the subpixel rendering operation unit 123 can directly receive the first image data D1*b* from the image input unit 132 without going through the image enhancement unit 121. In other words, the image enhancement unit 121 may be disposed according to actual design requirements, and the image data processor unit 122 may include the image enhancement unit 121 or not.

In the present embodiment, the subpixel rendering operation unit 123 outputs the second image data D2*b* to the image compression unit 124. The image compression unit 124 is configured to compress the second image data D2*b* to generate a third image data D3*b*, and output the third image data D3*b* to the storage unit 126. In the present embodiment, the storage unit 126 includes, for example, a frame buffer, which is configured to receive and store the third image data D3*b*. The image decompression unit 128 is configured to access the third image data D3*b* stored by the storage unit 126, and decompress the third image data D3*b* to generate a fourth image data D4*b*. A data quantity of the fourth image data D4*b* is equal to the data quantity of the second image data D2*b*. In the present embodiment, the fourth image data D4*b* is used as the output image data VOUT, and the display driver 120 drives the display panel 110 to display image frames according to the output image data VOUT. In view of the above, it can be known that in the present embodiment, with operations of the subpixel rendering operation unit 123 in the display driver 120, the display panel 110 can substantially display a high image resolution data with resolution greater than a panel resolution. For example, when the two-dimensional subpixel rendering operation includes the one-dimensional subpixel rendering operation performed twice in different directions with both subpixel sampling rates being 2/3, the display panel 110 with the panel resolution of 1440(pixel)*2560(line) is then able to display an image data with an image resolution of 2160 (pixel)*3840(line), such that the image quality of display panel 110 is improved.

It should be noted that, in the present embodiment and the subsequent embodiments, each subpixel data in the first image data D1*b* received by the image data processor unit 122 is a gray level value, whereas a subpixel data processed by the two-dimensional subpixel rendering operation is a luminance value instead of the gray level value. Therefore, the subpixel rendering operation unit 123 may also include an operation of converting the subpixel in the received first image data D1*b* (or the image data processed by the image enhancement unit 121) from the gray level value into the luminance value so the two-dimensional subpixel rendering operation can be performed. In the present embodiment and the subsequent embodiments, because each subpixel data in the second image data D2*b* generated after the two-dimensional subpixel rendering operation is performed by the subpixel rendering operation unit 123 is the luminance value, the subpixel rendering operation unit 123 may also include an operation of converting the luminance value into the gray level value followed by outputting the second image data D2*b* with data content being the gray level value to the image compression unit 124. Although the operations of converting the gray level value into the luminance value and converting the luminance value into the gray level value are not shown in the schematic diagram of each subsequent embodiment, person skilled in the art should be able to understand a processed image data type is the gray level value or the luminance value according to each unit block. In the embodiments of FIG. 3A and FIG. 3B, the subpixel rendering operation unit 123 performs the two-dimensional subpixel rendering operation on the first image data D1*b* to generate the second image data D2*b*, which is then processed by the image compression unit 124. As described above, compared to the data quantity of the first image data D1*b* being K bits, once the data quantity of the image processed by the subpixel rendering operation unit 123 is reduced to (4/9)K bits, the data quantity to be processed by the image compression unit 124 may be reduced so the storage unit 126 (the frame buffer) of a smaller memory size may be enough to store the compressed image data.

Figure 4:
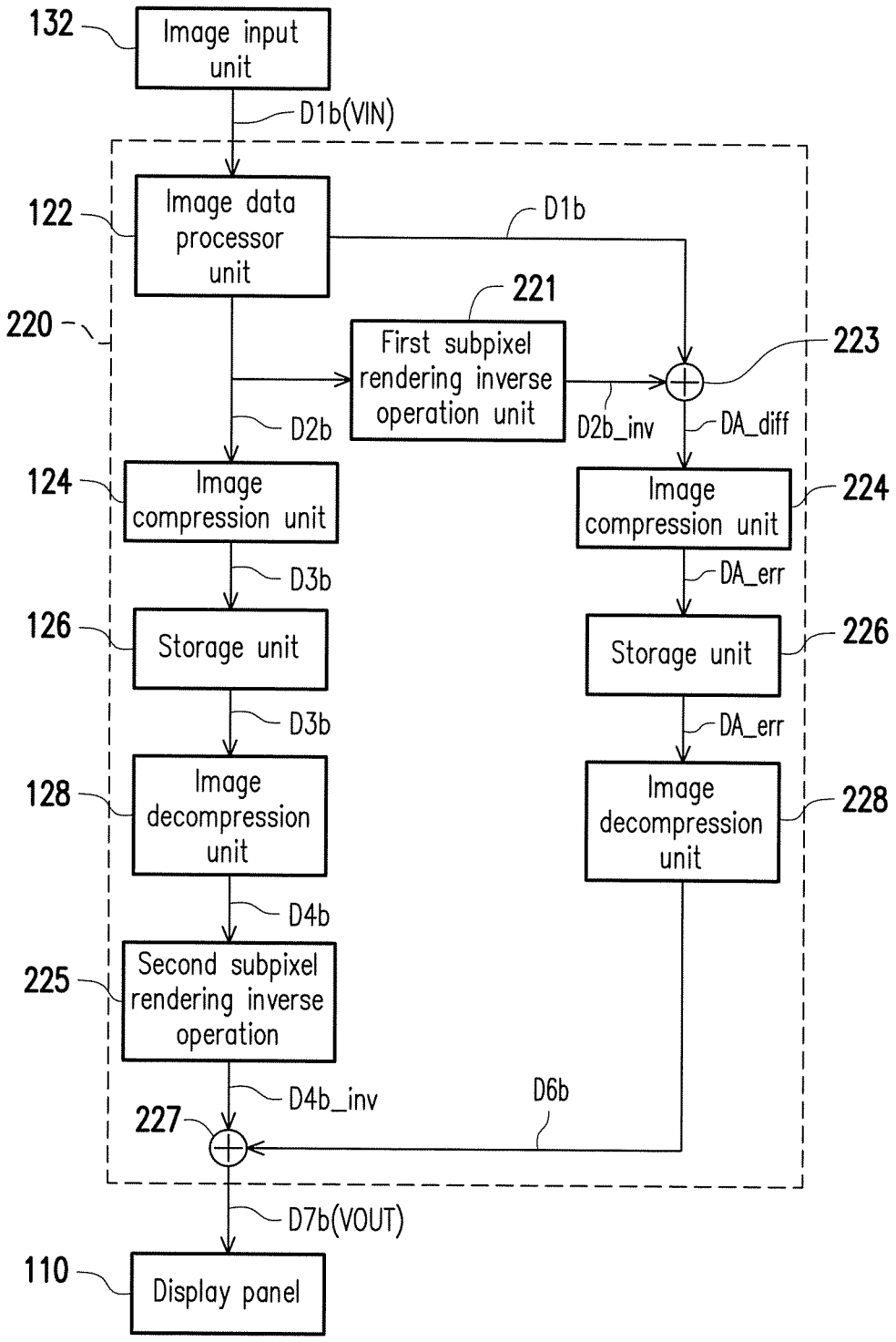
FIG. 4 is a schematic diagram of a display driver in another embodiment of the invention.

Since the subpixel rendering operation can easily lead to an object edge distortion in the image, another embodiment of the invention (e.g., FIG. 4) is provided to compensate such image distortion phenomenon. FIG. 4 is a schematic diagram of a display driver in another embodiment of the invention. With reference to FIG. 4, a display driver 220 of the present embodiment is similar to the display driver 120 of FIG. 3A, and the difference between the two display drivers is that, for example, the display driver 220 can further compensate the fourth image D4*b* according to an image error data DA_err (which is related to a difference between an image data not processed by the two-dimensional subpixel rendering operation and an inverse image data after being processed by the two-dimensional subpixel rendering operation and a two-dimensional subpixel rendering inverse operation) so the image display quality of the display panel 110 can be improved.

Specifically, the display driver 220 further includes a first subpixel rendering inverse operation unit 221, a first computation unit 223, an image compression unit 224, a storage unit 226, an image decompression unit 228, a second subpixel rendering inverse operation 225 and a second computation unit 227. In the present embodiment, the first subpixel rendering inverse operation unit 221 is configured to perform a two-dimensional subpixel rendering inverse operation on the second image data D2*b* to generate a first inverse image data D2*b*_inv. The first computation unit 223 is configured to calculate a difference DA_diff between the first image data D1*b* and the first inverse image data D2*b*_inv. The image compression unit 224 performs a data compression on the difference DA_diff to generate the image error data DA_err. In the present embodiment, the image compression unit 224 performs the data compression on the difference DA_diff by a distortion-less or low distortion compression method. In the present embodiment, the image compression unit 124 and the image compression unit 224 may be the same or different image compression units.

In the present embodiment, the image compression unit 224 outputs the image error data DA_err to the storage unit 226. The storage unit 226 is configured to receive and store the third image data DA_err. In the present embodiment, the storage unit 126 and the storage unit 226 may be the same or different storage units. The image decompression unit 228 is configured to access the image error data DA_err stored by the storage unit 226, decompress the image error data DA_err to generate a sixth image data D6*b* (which is equal to the difference DA_diff between the first image data D1*b* and the first inverse image data D2*b*_inv), and output the sixth image data D6*b* to the second computation unit 227. In the present embodiment, the image decompression unit 128 and the image decompression unit 228 may be the same or different image decompression units.

On the other hand, in the present embodiment, the second subpixel rendering inverse operation unit 225 is configured to perform the two-dimensional subpixel rendering inverse operation on the fourth image data D4*b* to generate a second inverse image data D4*b*_inv. The second computation unit 227 is configured to combine the sixth image data D6*b* and the second inverse image data D4*b*_inv to generate a seventh image data D7*b*. In this way, the object edge distortion in the image possibly caused by the subpixel rendering inverse operation may be compensated. Accordingly, in the present embodiment, the seventh image data D7*b* is used as the output image data VOUT, and the display driver 220 drives the display panel 110 to display image frames according to the output image data VOUT so the image quality can be improved.

In another embodiment, if it is known that the input image data VIN does not include obvious object edges, the first subpixel rendering inverse operation unit 221, the first computation unit 223, the image compression unit 244, the storage unit 226, the image decompression unit 228 and the second computation unit 227 in FIG. 4 may also be omitted. In this case, the display driver 220 can drive the display panel 110 to display image frames according to the second inverse image data D4*b*_inv generated by the second subpixel rendering inverse operation unit 225.

Figure 5:
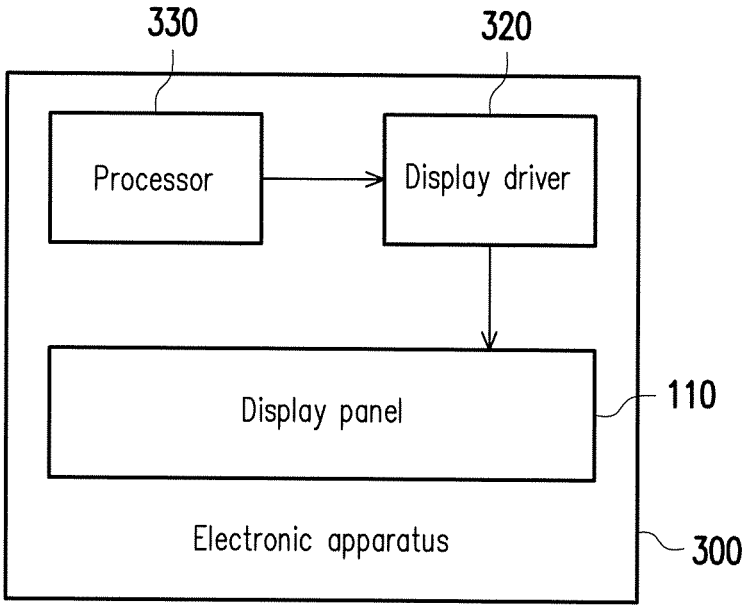
FIG. 5 is a schematic diagram illustrating an electronic apparatus in an embodiment of the invention.
Figure 6:
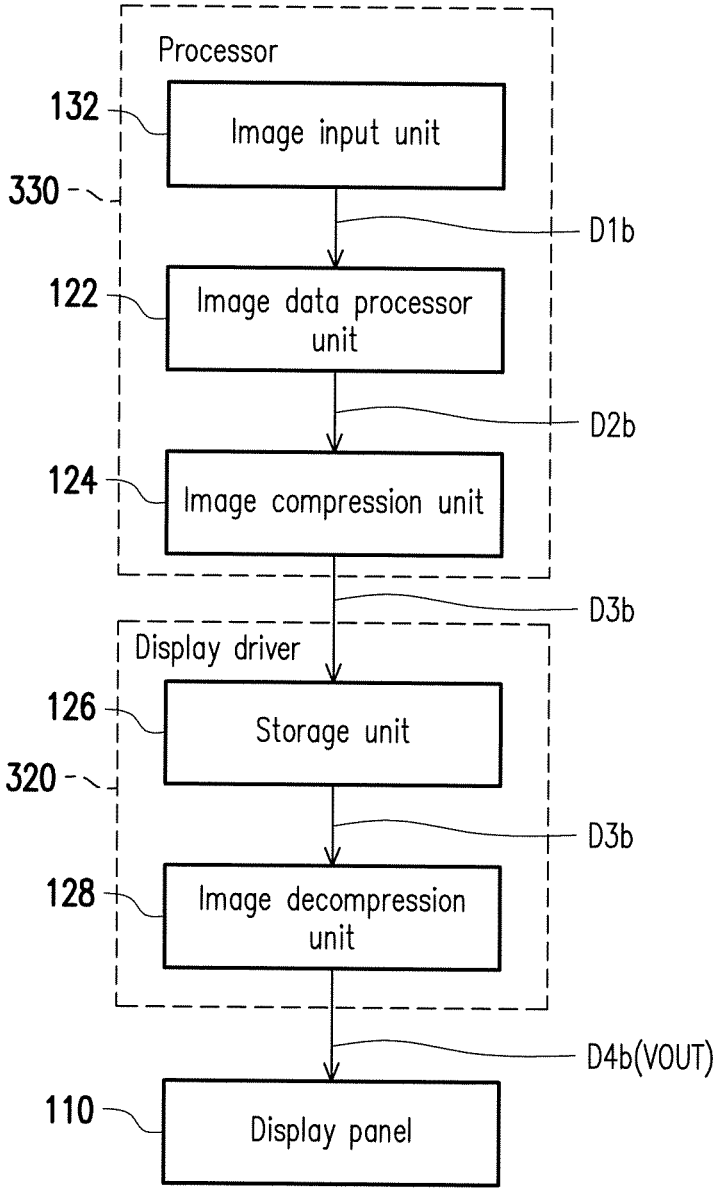
FIG. 6 is a schematic diagram of the display driver and the processor in the embodiment of FIG. 5.

FIG. 5 is a schematic diagram illustrating an electronic apparatus in an embodiment of the invention. FIG. 6 is a schematic diagram of a display driver and a processor in the embodiment of FIG. 5. With reference to FIG. 5 and FIG. 6, an electronic apparatus 300 of the present embodiment includes the display panel 110, a display driver 320 and a processor 330. The processor 330 is used as an image data transmitter, and the display driver 320 is used as an image data receiver. In the present embodiment, the electronic apparatus 300 is, for example, a cell phone, a tablet computer or a camera. The processor 330 is, for example, an application processor (AP).

In the present embodiment, the image input unit 132, the image data processor unit 122 and the image compression unit 124 are disposed in the processor 330 of the electronic apparatus 300. As shown in FIG. 3B, the image data processor unit 122 at least includes the subpixel rendering operation unit 123, which is configured to perform the two-dimensional subpixel rendering operation (e.g., the one-dimensional subpixel rendering operation performed twice in different directions with both the subpixel sampling rates being 2/3). The storage unit 126 and the image decompression unit 128 are disposed in the display driver 320 of the electronic apparatus 300. The display driver 320 is configured to receive the third image data D3*b* from the processor 330 and drive the display panel 110 according to the fourth image data D4*b*. In the present embodiment, the image data processor unit 122 performs the two-dimensional subpixel rendering operation on the first image data D1*b* to generate the second image data D2*b*. The second image data D2*b* is compressed to generate the third image data D3*b*. Compared to the data quantity of the first image data D1*b*, data quantities of the second image data D2*b* and the third image data D3*b* may be reduced. In this way, a transmission bandwidth between the processor 330 (the image data transmitter) and the display driver 320 (the image data receiver) may be reduced. Accordingly, the storage unit 126 (the frame buffer) of a smaller memory size may then be enough so overall costs may be reduced. For instance, when the data quantity of the first image data D1*b* is K bits and the two-dimensional subpixel rendering operation performed by the subpixel rendering operation unit 123 includes the one-dimensional subpixel rendering operation performed twice in different directions with both the subpixel sampling rates being 2/3, the data quantity of the second image data D2*b* will be (4/9)K bits; also, if a data compression rate of the image compression unit 124 is 1/3, the data quantity of the third image data D3*b* will only be 4/27 the data quantity of the first image data D1*b*.

In addition, sufficient teaching, suggestion, and implementation regarding an operation method of the electronic apparatus and the method for generating the display data of the display panel of the present embodiment the invention may be obtained from the foregoing embodiments of FIG. 1 to FIG. 4, and thus related descriptions thereof are not repeated hereinafter.

Figure 7:
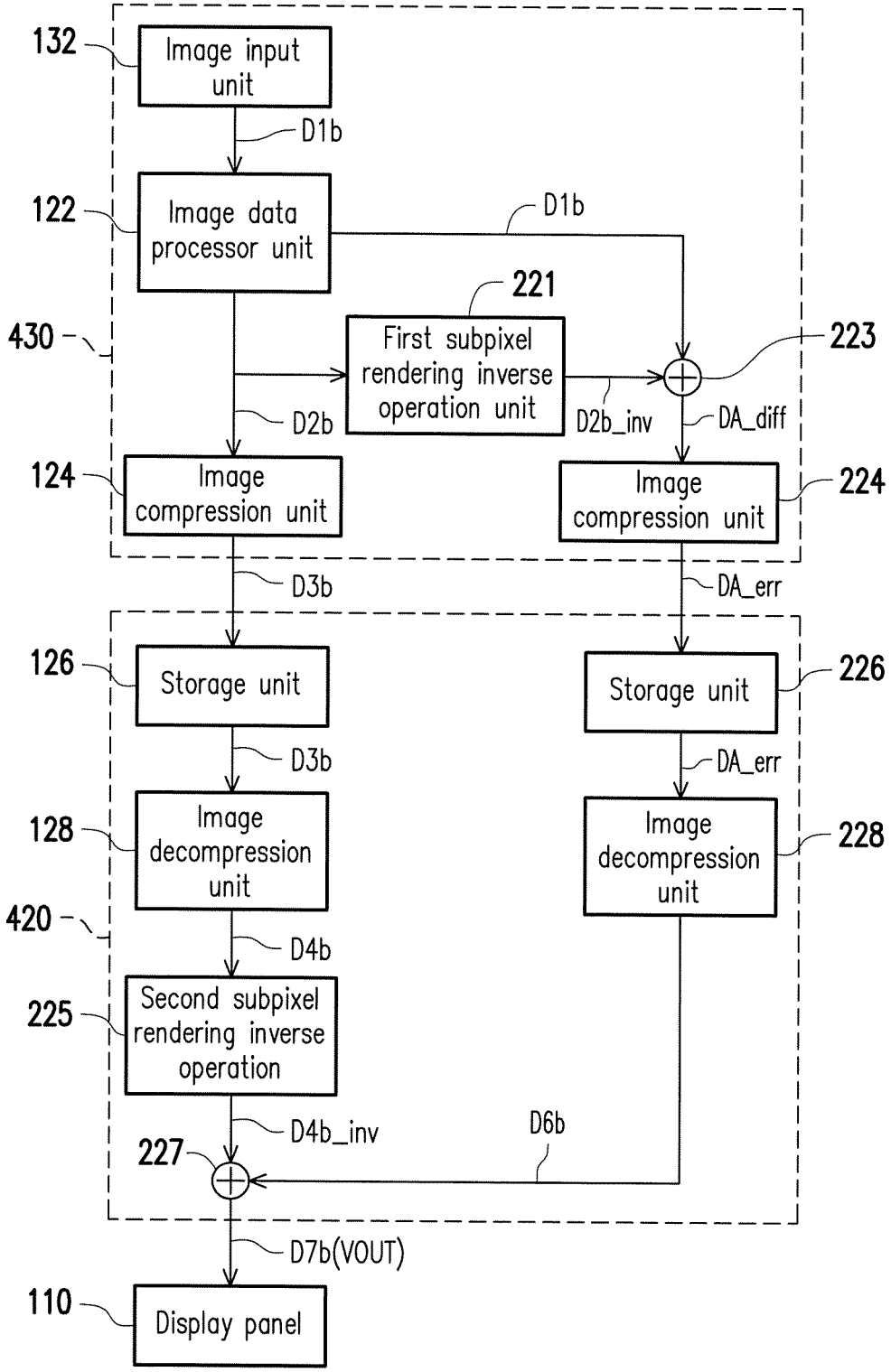
FIG. 7 is a schematic diagram of a display driver and a processor in another embodiment of the invention.

FIG. 7 is a schematic diagram of a display driver and a processor in another embodiment of the invention. With reference to FIG. 6 and FIG. 7, a display driver 420 and a processor 430 of the present embodiment are similar to the display driver 320 and the processor 330 of FIG. 6, and the difference between them is that, for example, the processor 430 further calculates the difference DA_diff between the first image data D1*b* and the first inverse image data D2*b*_inv. The processor 430 compresses the difference DA_diff into the image error data DA_err to be transferred to the display driver 420. The display driver 420 further compensates the fourth image data D4*b* according to the difference DA_diff (as the image data D6*b*) obtained after decompressing the image error data DA_err, so the image display quality of the display panel 110 can be improved while compensating the image distortion (e.g., the object edge distortion in the image) possibly caused by the subpixel rendering operation. In addition, sufficient teaching, suggestion, and implementation regarding an operation method of the electronic apparatus and the method for generating the display data of the display panel of the present embodiment the invention may be obtained from the foregoing embodiments of FIG. 1 to FIG. 6, and thus related descriptions thereof are not repeated hereinafter.

In the exemplary embodiments of the invention, the subpixel rendering operation is, for example, to convert an original subpixel data into a rendered subpixel data. The subpixel rendering inverse operation is, for example, to convert the rendered subpixel data into the original subpixel data. In an exemplary embodiment of the invention, each original pixel data includes, for example, at least one red subpixel data, at least one green subpixel data and at least one blue subpixel data. Each rendered pixel data includes, for example, at least two of a red subpixel data, a green subpixel data and a blue subpixel data. In an exemplary embodiment of the invention, each of the subpixel rendering operation unit 123, the first subpixel rendering inverse operation unit 221 and the second subpixel rendering inverse operation unit 225 may be implemented by any hardware or software for performing the subpixel rendering operation or the subpixel rendering inverse operation in the field, which is not particularly limited in the invention. Enough teaching, suggestion, and implementation illustration for implementations of the subpixel rendering operation unit 123, the first subpixel rendering inverse operation unit 221 and the second subpixel rendering inverse operation unit 225 may be obtained with reference to common knowledge in the related art, which is not repeated hereinafter.

In an exemplary embodiment of the invention, each of the display panel 110, the display drivers 120 and 320, the image enhancement unit 121, the image data processor unit 122, the image compression units 124 and 224, the storage units 126 and 226, the image decompression units 128 and 228, the image input unit 132, the first computation unit 223, the second computation unit 227 and the processor 330 may be implemented by any hardware or software in the field, which is not particularly limited in the invention. Enough teaching, suggestion, and implementation illustration for implementations of aforesaid units and processor may be obtained with reference to common knowledge in the related art, which is not repeated hereinafter.

Various embodiments are provided below to describe the two-dimensional subpixel rendering operation. The image data generated by the two-dimensional subpixel rendering operation according to the exemplary embodiments of the invention can be written into the display panel including the liquid crystal display panel or the organic light-emitting diode panel. Type of the display panel is not particularly limited in the invention.

Figure 8:
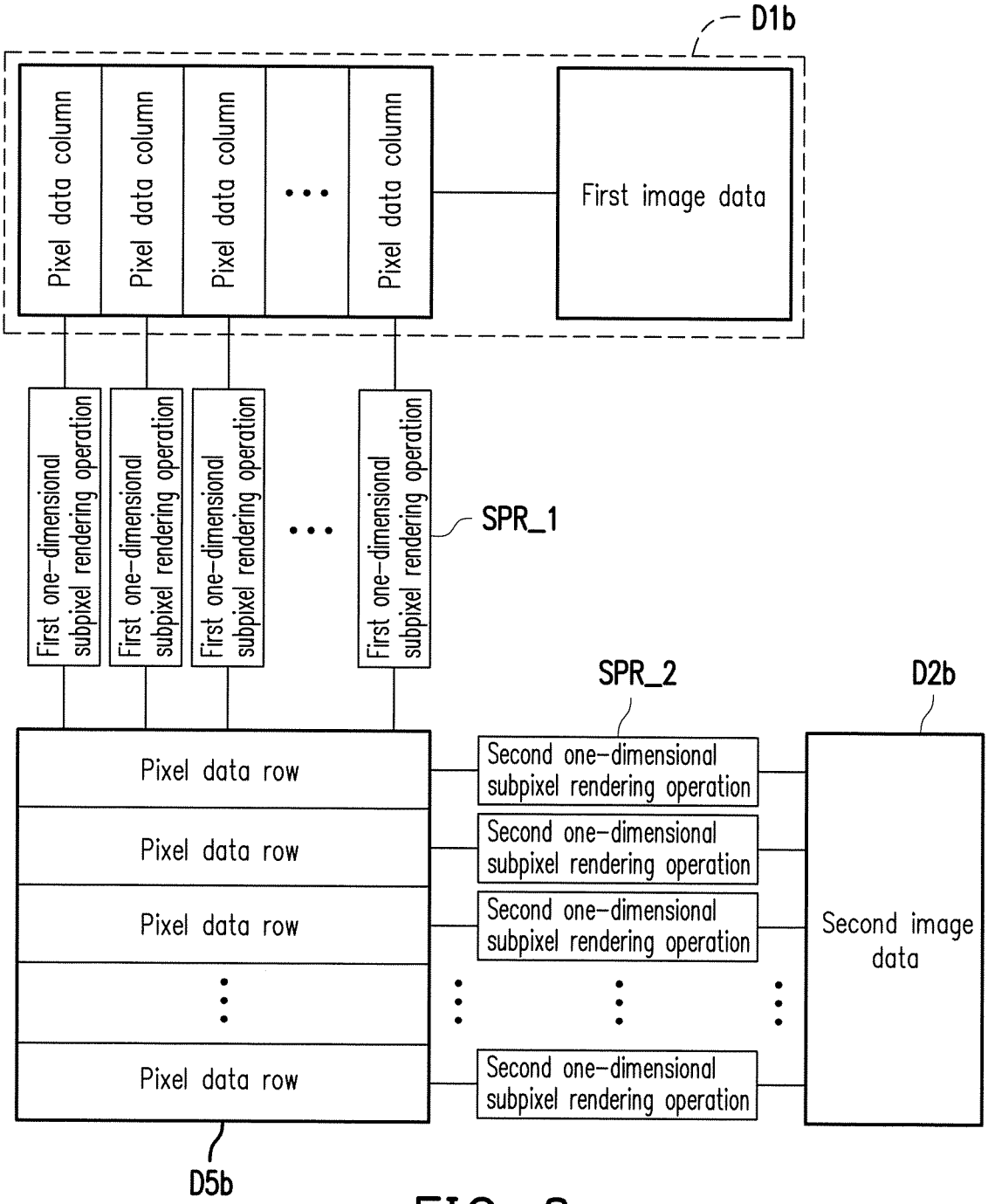
FIG. 8 is a schematic diagram illustrating a two-dimensional subpixel rendering operation in an embodiment of the invention.

FIG. 8 is a schematic diagram illustrating a two-dimensional subpixel rendering operation in an embodiment of the invention. With reference to FIG. 3A and FIG. 8, the first image data D1*b* of the present embodiment is used as the input image data, and the image data processor unit 122 performs the two-dimensional subpixel rendering operation on the first image data D1*b* to generate the second image data D2*b*, which is used as the output image data of the image data processor unit 122. In the present embodiment, the two-dimensional subpixel rendering operation includes a first one-dimensional subpixel rendering operation SPR_1 in a pixel column direction and a second one-dimensional subpixel rendering operation SPR_2 in a pixel row direction. A data value of the subpixel data processed by the two-dimensional subpixel rendering operation is the luminance value.

Specifically, in the present embodiment, the first image data D1*b* includes a plurality of pixel data columns. The image data processor unit 122 performs the first one-dimensional subpixel rendering operation SPR_1 in the pixel column direction on the first image data D1*b* (input image data) to generate a fifth image data D5*b* (rendered image data). The fifth image data D5*b* includes a plurality of pixel data rows. It should be noted that, in the present embodiment, the first one-dimensional subpixel rendering operation SPR_1 in the pixel column direction is performed without waiting until the entire first image data D1*b* or one entire pixel data column therein is completely received. Rather, the first one-dimensional subpixel rendering operation SPR_1 may be performed based on the number of pixel data in the pixel column direction that can be taken as a unit, which may be determined according to the subpixel sampling rate of the pixel column direction. Subsequently, the image data processor unit 122 performs the second one-dimensional subpixel rendering operation SPR_2 in the pixel row direction on the fifth image data D5*b* to generate the second image data D2*b* (output image data). It should be noted that, in the present embodiment, the second one-dimensional subpixel rendering operation SPR_2 in the pixel row direction is performed without waiting until the entire fifth image data D5*b* is completely received. Instead, the second one-dimensional subpixel rendering operation SPR_2 may be performed after at least one row of the pixel data in the fifth image data D5*b* is generated, for example, based on the number of pixel data in the pixel row direction that can be taken as a unit, which may be determined according to the subpixel sampling rate of the pixel row direction.

In the present embodiment, the image data processor unit 122 performs the first one-dimensional subpixel rendering operation SPR_1 in the pixel data columns of the first image data D1*b* first, and then performs the second one-dimensional subpixel rendering operation SPR_2 in the pixel data rows of the fifth image data D5*b*. However, the invention is not limited thereto. In an embodiment, the image data processor unit 122 may also perform the second one-dimensional subpixel rendering operation SPR_2 in the pixel data rows of the first image data D1*b* first, and then perform the first one-dimensional subpixel rendering operation SPR_1 in the pixel data columns of the fifth image data D5*b*. In an embodiment, the image data processor unit 122 may also perform the two-dimensional subpixel rendering operation on the first image data D1*b* by a pixel data array having a total of m*n pixel data as a basis unit rather than performing the one-dimensional subpixel rendering operation in different directions. Here, m is the number of pixel data of the pixel row direction in the pixel data array, and n is the number of pixel data of the pixel column direction in the pixel data array.

Figure 9:
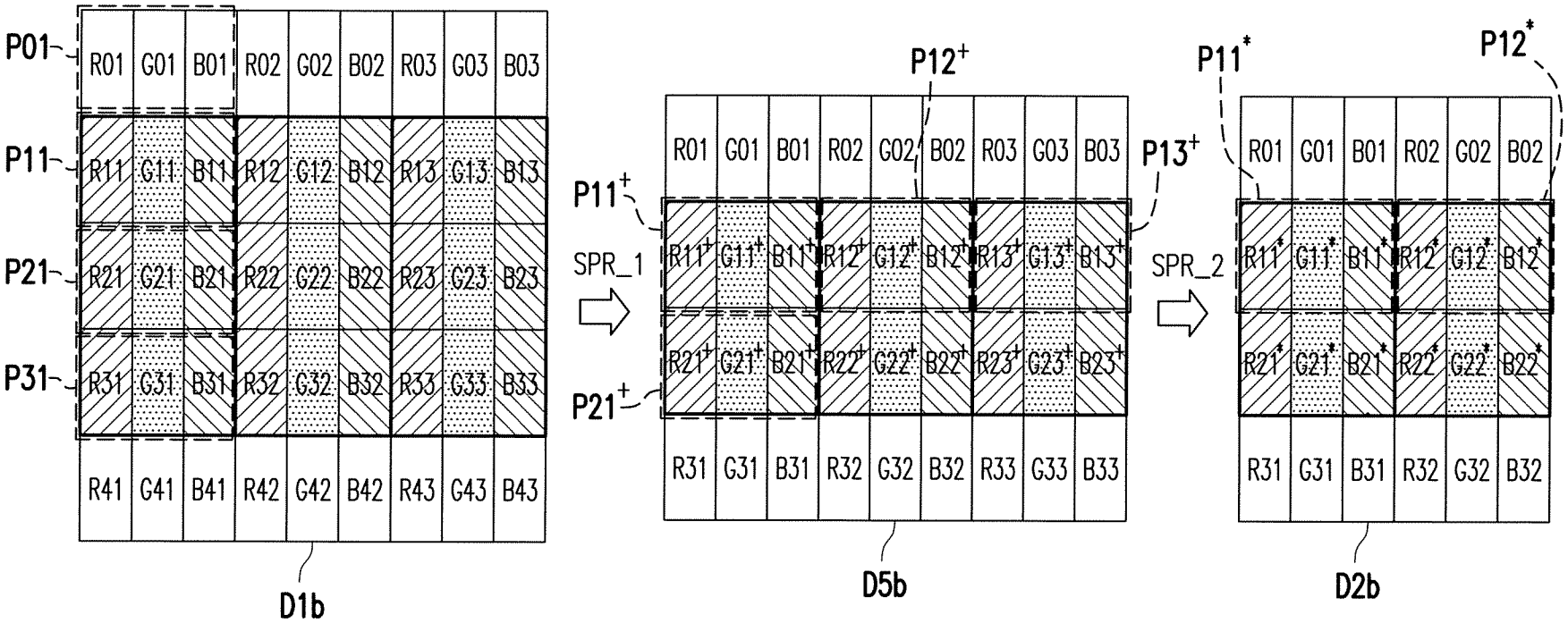
FIG. 9 is a schematic diagram illustrating a two-dimensional subpixel rendering operation of FIG. 8.

FIG. 9 is a schematic diagram illustrating a two-dimensional subpixel rendering operation of FIG. 8. With reference to FIG. 9, in the present embodiment, a subpixel sampling rate of the first one-dimensional subpixel rendering operation SPR_1 and a subpixel sampling rate of the second one-dimensional subpixel rendering operation SPR_2 are both 2/3. The pixel data labeled in FIG. 9 are parts of the first image data D1*b*, the fifth image data D5*b* and the second image data D2*b*. For instance, after being processed by the first one-dimensional subpixel rendering operation SPR_1 in the pixel column direction, three pixel data P11, P21 and P31 in one pixel data column in the first image data D1*b* are converted into two pixel data P11$^+$ and P21$^+$ (a.k.a. the rendered pixel data) in one pixel data column in the fifth image data D5*b*; similarly, after being processed by the first one-dimensional subpixel rendering operation SPR_1 in the pixel column direction, three pixel data P12, P22 and P32 in another pixel data column in the first image data D1*b* are converted into two pixel data P12$^+$ and P22$^+$ in another pixel data column in the fifth image data D5*b*.

Subsequently, after being processed by the second one-dimensional subpixel rendering operation SPR_2 in the pixel row direction, three pixel data P11$^+$, P12$^+$, and P13$^+$ in one pixel data row in the fifth image data D5*b* are converted into two pixel data P11* and P12* (a.k.a. the output pixel data) in one pixel data row in the second image data D2*b*; similarly, after being processed by the second one-dimensional subpixel rendering operation SPR_2 in the pixel row direction, three pixel data P21', P22$^+$ and P23$^+$ in another pixel data row in the fifth image data D5*b* are converted into two pixel data P21* and P22* in another pixel data row in the second image data D2*b*.

In the present embodiment, the image data processor unit 122 performs the first one-dimensional subpixel rendering operation SPR_1 in the pixel data columns of the first image data D1*b* to generate the fifth image data D5*b*. Each of the multiple subpixel data for the first one-dimensional subpixel rendering operation SPR_1 has a corresponding color diffusion ratio, and thus the first one-dimensional subpixel rendering operation SPR_1 may be regarded as being performed on the multiple subpixel data by using a set of color diffusion ratios (which includes two or more color diffusion ratios). Data values of a part of subpixel data in the fifth image data D5*b* may be obtained by calculations based on the following equations:

$$R11^+ = \frac{1}{2}R11 + \frac{1}{2}R01,\ G11^+ = \frac{1}{2}G11 + \frac{1}{2}G21,\ B11^+ = \frac{1}{2}B21 + \frac{1}{2}B11,$$

-continued $$R21^+ = \frac{1}{2}R21 + \frac{1}{2}R31,\ G21^+ = \frac{1}{2}G31 + \frac{1}{2}G21 \text{ and}$$

$$B21^+ = \frac{1}{2}B31 + \frac{1}{2}B41.$$

Here, symbols R11$^+$, R21$^+$, G11$^+$, G21$^+$, B11$^+$ and B21$^+$ denote the subpixel data in the fifth image data D5*b* and the data values thereof, symbols R01, R11, R31, G11, G21, G31, B11, B21, B31 and B41 denote the subpixel data in the first image data D1*b* and the data values thereof, and the set of color diffusion ratios being used is {1/2, 1/2}.

Specifically, taking the subpixel data R11$^+$ for example, the first one-dimensional subpixel rendering operation SPR_1 includes computing the subpixel data R11 and R01 respectively according to the corresponding color diffusion ratio in the set of color diffusion ratios {1/2, 1/2} to generate the subpixel data R11$^+$. The subpixel data R11 and R01 are located in the pixel data P11 and P01 respectively, and the pixel data P11 and P01 are two adjacent pixel data arranged along the pixel column direction. Taking the subpixel data R21$^+$ for example, the first one-dimensional subpixel rendering operation SPR_1 includes computing the subpixel data R21 and R31 respectively according to the corresponding color diffusion ratio in the set of color diffusion ratios {1/2, 1/2} to generate the subpixel data R21$^+$. The subpixel data R21 and R31 are located in the pixel data P21 and P31 respectively, and the pixel data P21 and P31 are two adjacent pixel data arranged along the pixel column direction. The generation approach for the rest of subpixel data may be derived from the above.

In the present embodiment, a subpixel sampling rate of the first one-dimensional subpixel rendering operation SPR_1 is, for example, 2/3. For one pixel data in the input image data such as the pixel data P21, the subpixel data B21 therein (a first color subpixel data) is assigned as a part of the subpixel data B11$^+$ (a first color component) of the pixel data P11 according to the color diffusion ratio 1/2. Also, the subpixel data R21 (a second color subpixel data) of the pixel data P21 is assigned as a part of the subpixel data R21$^+$ (second color component) of the pixel data P21$^+$ according to the color diffusion ratio 1/2. The pixel data P21 is a pixel data corresponding to a middle row among the three consecutive pixel data P11, P21 and P31 arranged along the pixel column direction in the first image data D1*b*. The pixel data P11$^+$ and the pixel data P21$^+$ are two consecutive pixel data arranged along the pixel column direction in the fifth image data D5*b*.

In the present embodiment, the image data processor unit 122 performs the second one-dimensional subpixel rendering operation SPR_2 in the pixel data columns of the fifth image data D5*b* to generate the second image data D2*b*. Each of the multiple subpixel data for the second one-dimensional subpixel rendering operation SPR_2 has a corresponding color diffusion ratio, and thus the second one-dimensional subpixel rendering operation SPR_2 may be regarded as being performed by using a set of color diffusion ratios (which includes two or more color diffusion ratios). Data values of a part of subpixel data in the second image data D2*b* may be obtained by calculations based on the following equations:

$$R11^* = \frac{1}{2}R11^+ + \frac{1}{2}R10^+,\ G11^* = \frac{1}{2}G11^+ + \frac{1}{2}G12^+,$$

-continued $$B11^* = \frac{1}{2}B12^+ + \frac{1}{2}B11^+,\ R12^* = \frac{1}{2}R12^+ + \frac{1}{2}R13^+,$$

$$G12^* = \frac{1}{2}G13^+ + \frac{1}{2}G12^+ \text{ and } B12^* = \frac{1}{2}B13^+ + \frac{1}{2}B12^+.$$

Here, symbols R11*, R12*, G11*, G12*, B11* and B12* denote the subpixel data in the second image data D2*b* and the data values thereof, and symbols R11$^+$, R12$^+$, R13$^+$, G11$^+$, G12$^+$, G13$^+$, B11$^+$, B12$^+$ and B13$^+$ denote the subpixel data in the fifth image data D5*b* and the data values thereof.

Specifically, taking the subpixel data R12* for example, the second one-dimensional subpixel rendering operation SPR_2 includes computing the subpixel data R12$^+$ and R13$^+$ respectively according to the corresponding color diffusion ratio in the set of color diffusion ratios {1/2, 1/2} to generate the subpixel data R21*. The subpixel data R12$^+$ and R13$^+$ are located in the pixel data P12$^+$ and P13$^+$ respectively, and the pixel data P12$^+$ and P13$^+$ are two adjacent pixel data arranged along the pixel row direction. The generation approach for the rest of subpixel data may be derived from the above. In the present embodiment, although the first one-dimensional subpixel rendering operation SPR_1 and the second one-dimensional subpixel rendering operation SPR_2 use the same subpixel sampling rates (both are 2/3) and the same set of color diffusion ratios (both are {1/2, 1/2}), but the invention is not limited thereto. In other embodiments, the first one-dimensional subpixel rendering operation SPR_1 and the second one-dimensional subpixel rendering operation SPR_2 can use different subpixel sampling rates or different set of color diffusion ratios.

Figure 10:
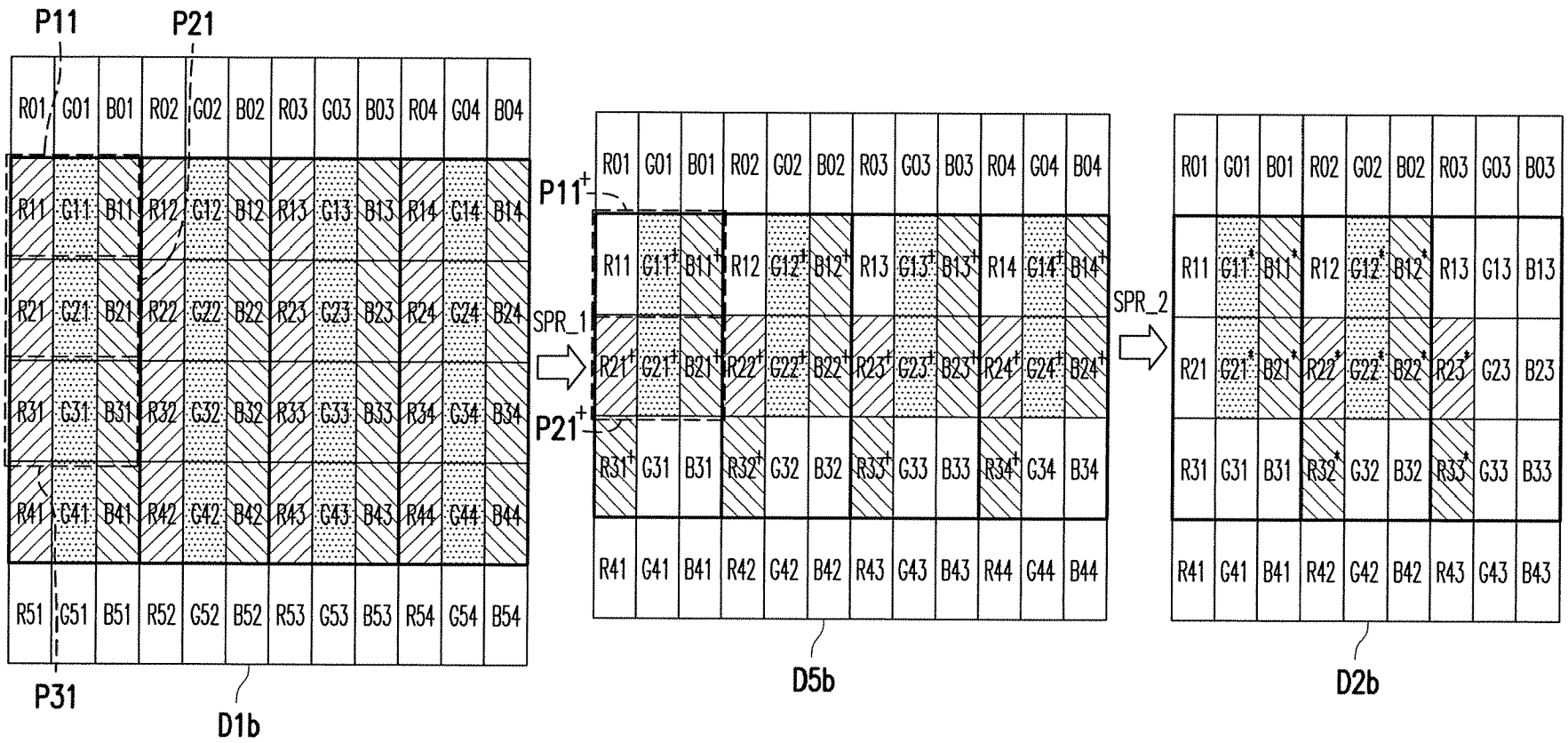
FIG. 10 is a schematic diagram illustrating a two-dimensional subpixel rendering operation in another embodiment of the invention.

FIG. 10 is a schematic diagram illustrating a two-dimensional subpixel rendering operation in another embodiment of the invention. With reference to FIG. 10, in the present embodiment, a subpixel sampling rate of the first one-dimensional subpixel rendering operation SPR_1 and a subpixel sampling rate of the second one-dimensional subpixel rendering operation SPR_2 are both 1/2.

In the present embodiment, the image data processor unit 122 performs the first one-dimensional subpixel rendering operation SPR_1 on the pixel data columns of the first image data D1*b* to generate the fifth image data D5*b*. Data values of a part of subpixel data in the fifth image data D5*b* may be obtained by calculations based on the following equations:

$$G11^+ = \frac{1}{2}G11 + \frac{1}{4}(G01 + G21),\ B11^+ = \frac{1}{2}B21 + \frac{1}{2}B11,$$

$$R21^+ = \frac{1}{2}R21 + \frac{1}{2}R31,\ G21^+ = \frac{1}{2}G31 + \frac{1}{2}(G21 + G41),$$

$$B21^+ = \frac{1}{2}B31 + \frac{1}{2}B41 \text{ and } R31^+ = \frac{1}{2}R41 + \frac{1}{2}R51.$$

Here, symbols R21$^+$, R31$^+$, G11$^+$, G21$^+$, B11$^+$ and B21$^+$ denote the subpixel data in the fifth image data D5*b* and the data values thereof, and symbols R21, R31, R41, R51, G01, G21, G31, G41, B11, B21, B31 and B41 denote the subpixel data in the first image data D1*b*. and the data values thereof Specifically, in the present embodiment, the set of color diffusion ratios may have different ratios according to colors represented by the subpixel data for the subpixel rendering operation. For example, the set of color diffusion ratios used corresponding to the green subpixel data is {1/4, 1/2, 1/4}, and the set of color diffusion ratios used corresponding to the red or blue subpixel data is {1/2, 1/2}. Taking the subpixel data G11$^+$ for example, the first one-dimensional subpixel rendering operation SPR_1 includes computing the subpixel data G01, G11 and G21 according to the set of color diffusion ratios {1/4, 1/2, 1/4} to generate the subpixel data G11$^+$. Taking the subpixel data R21$^+$ for example, the first one-dimensional subpixel rendering operation SPR_1 includes computing the subpixel data R21 and R31 according to the set of color diffusion ratios {1/2, 1/2} to generate the subpixel data R21$^+$. The generation approach for the rest of subpixel data may be derived from the above.

In the present embodiment, a subpixel sampling rate of the first one-dimensional subpixel rendering operation SPR_1 is, for example, 1/2. The subpixel data B21 (first color subpixel data) of the pixel data P21 is assigned as a part of the subpixel data B11$^+$ (first color component) of the pixel data P11$^+$ according to the color diffusion ratio 1/2. Also, the subpixel data R21 (second color subpixel data) of the pixel data P21 is assigned as a part of the subpixel data R21$^+$ (second color component) of the pixel data P21$^+$ according to the color diffusion ratio 1/2. The pixel data P21 is a pixel data among the two consecutive pixel data P11 and P21 arranged along the pixel column direction in the first image data D1*b*. The pixel data P11$^+$ and the pixel data P21$^+$ are two consecutive pixel data arranged along the pixel column direction in the fifth image data D5*b*.

In the present embodiment, the image data processor unit 122 performs the second one-dimensional subpixel rendering operation SPR_2 in the pixel data columns of the fifth image data D5*b* to generate the second image data D2*b*. Data values of a part of subpixel data in the second image data D2*b* may be obtained by calculations based on the following equations:

$$G11^* = \frac{1}{2}G11^+ + \frac{1}{4}(G10^+ + G12^+),\ B11^* = \frac{1}{2}B11^+ + \frac{1}{2}B12^+,$$

$$R21^* = \frac{1}{2}R12^+ + \frac{1}{2}R13^+,\ G12^* = \frac{1}{2}G13^+ + \frac{1}{4}(G12^+ + G14^+),$$

$$B12^* = \frac{1}{2}B13^+ + \frac{1}{2}B14^+ \text{ and } R13^* = \frac{1}{2}R14^+ + \frac{1}{2}R15^+.$$

Here, symbols R12*, R13*, G11*, G12*, B11* and B12* denote the subpixel data in the second image data D2*b* and the data values thereof, and symbols R12$^+$, R13$^+$, R14$^+$, G10$^+$, G11$^+$, G12$^+$, G13$^+$, G14$^+$, B11$^+$, B12$^+$ and B14$^+$ denote the subpixel data in the fifth image data D5*b* and the data values thereof.

Specifically, taking the subpixel data G11* for example, the second one-dimensional subpixel rendering operation SPR_2 includes computing the subpixel data G10$^+$, G11$^+$ and G12$^+$ respectively according to the corresponding color diffusion ratio in the set of color diffusion ratios {1/4, 1/2, 1/4} to generate the subpixel data G11*. Taking the subpixel data B11* for example, the second one-dimensional subpixel rendering operation SPR_2 includes computing the subpixel data B11$^+$ and B12$^+$ respectively according to the corresponding color diffusion ratio in the set of color diffusion ratios {1/2, 1/2} to generate the subpixel data B11*. The generation approach for the rest of subpixel data may be derived from the above.

In FIG. 9 and FIG. 10, arrangements of the pixel data and the subpixel data in the first image data D1*b*, the second image data D2*b* and the fifth image data D5*b* are corresponding to pixels and subpixels in the display panel. In the present embodiment, the display drivers 120 and 320 drive the display panel according to the second image data D2*b*, for example.

In FIG. 9 and FIG. 10, an arrangement of the subpixels in the display panels driven by the display drivers 120 and 320 is, for example, a RGB stripe arrangement. In an embodiment, the arrangement of the subpixels in the display panels driven by the display drivers 120 and 320 may also be a RGB delta arrangement.

Figure 11:
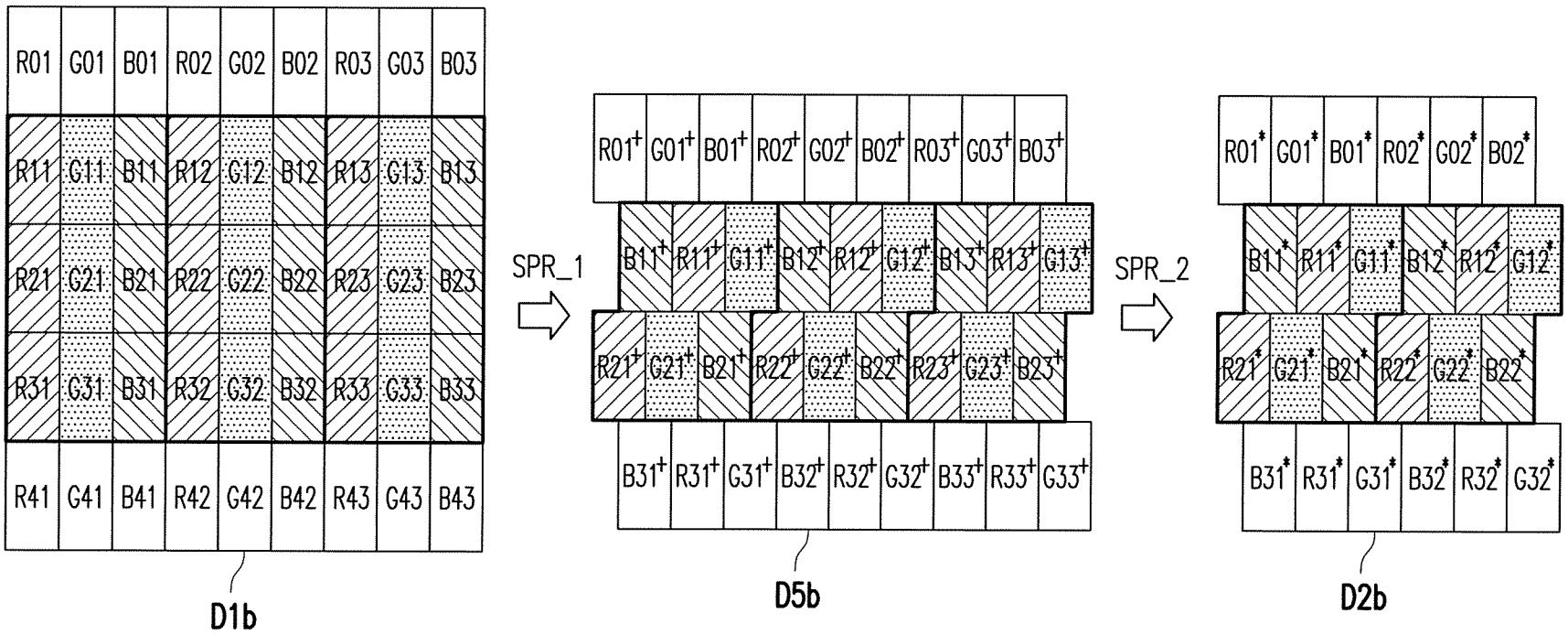
FIG. 11 and FIG. 12 are schematic diagrams of two-dimensional subpixel rendering operations in different embodiments of the invention.
Figure 12:
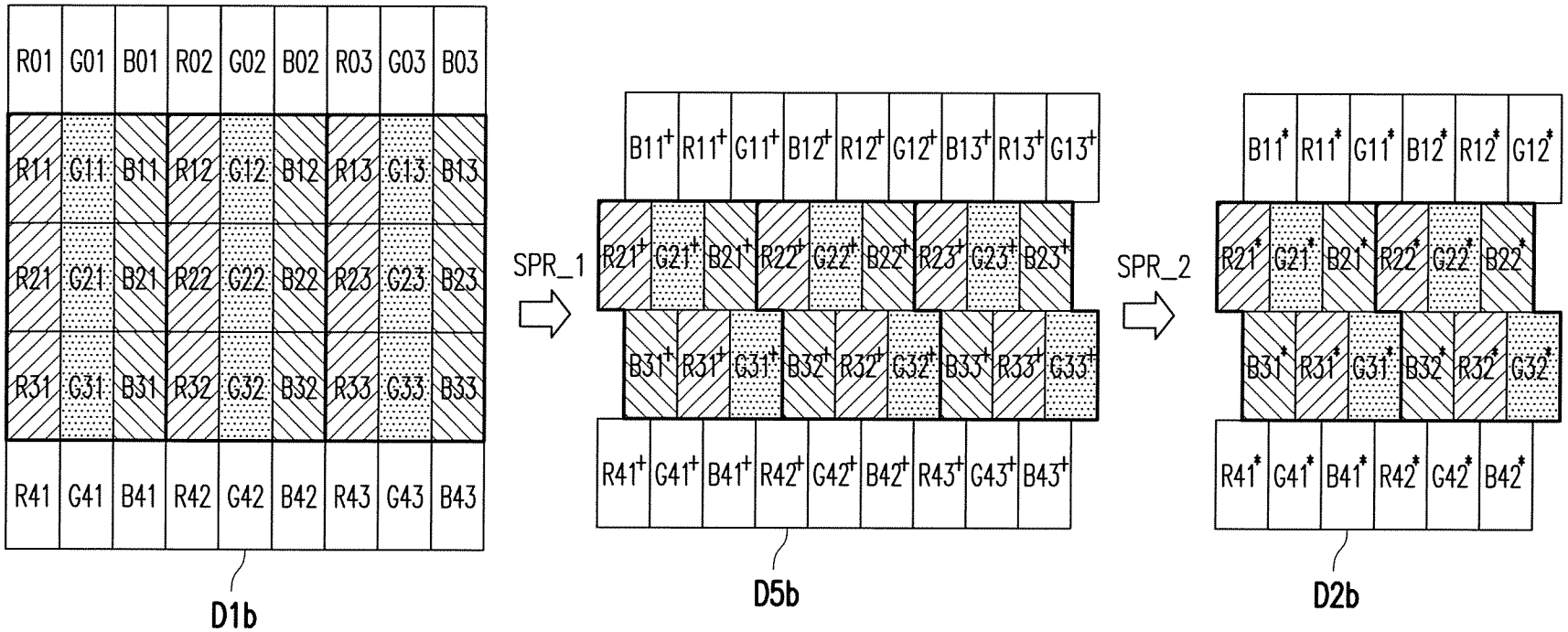

FIG. 11 and FIG. 12 are schematic diagrams of two-dimensional subpixel rendering operations in different embodiments of the invention. With reference to FIG. 11 and FIG. 12, both subpixel sampling rates of SPR_1 and SPR_2 in the two-dimensional subpixel rendering operations in the embodiments of FIG. 11 and FIG. 12 are 2/3. In FIG. 11 and FIG. 12, arrangements of the pixel data and the subpixel data in the first image data D1*b*, the second image data D2*b* and the fifth image data D5*b* are corresponding to pixels and subpixels in the display panel. In FIG. 11 and FIG. 12, an arrangement of the subpixels in the display panels driven by the display drivers 120 and 320 is the same type of RGB stripe arrangement, or colors of starting subpixels from each display line in the display panel are different. The difference between FIG. 11 and FIG. 12 is that, the first one-dimensional subpixel rendering operations SPR_1 in the pixel column direction in the two embodiments generate the fifth image data D5*b* according to the different combinations of subpixel data, and the second one-dimensional subpixel rendering operations SPR_2 in the pixel row direction in the two embodiments also generate the second image data D2*b* according to the different combinations of subpixel data.

Figure 13:
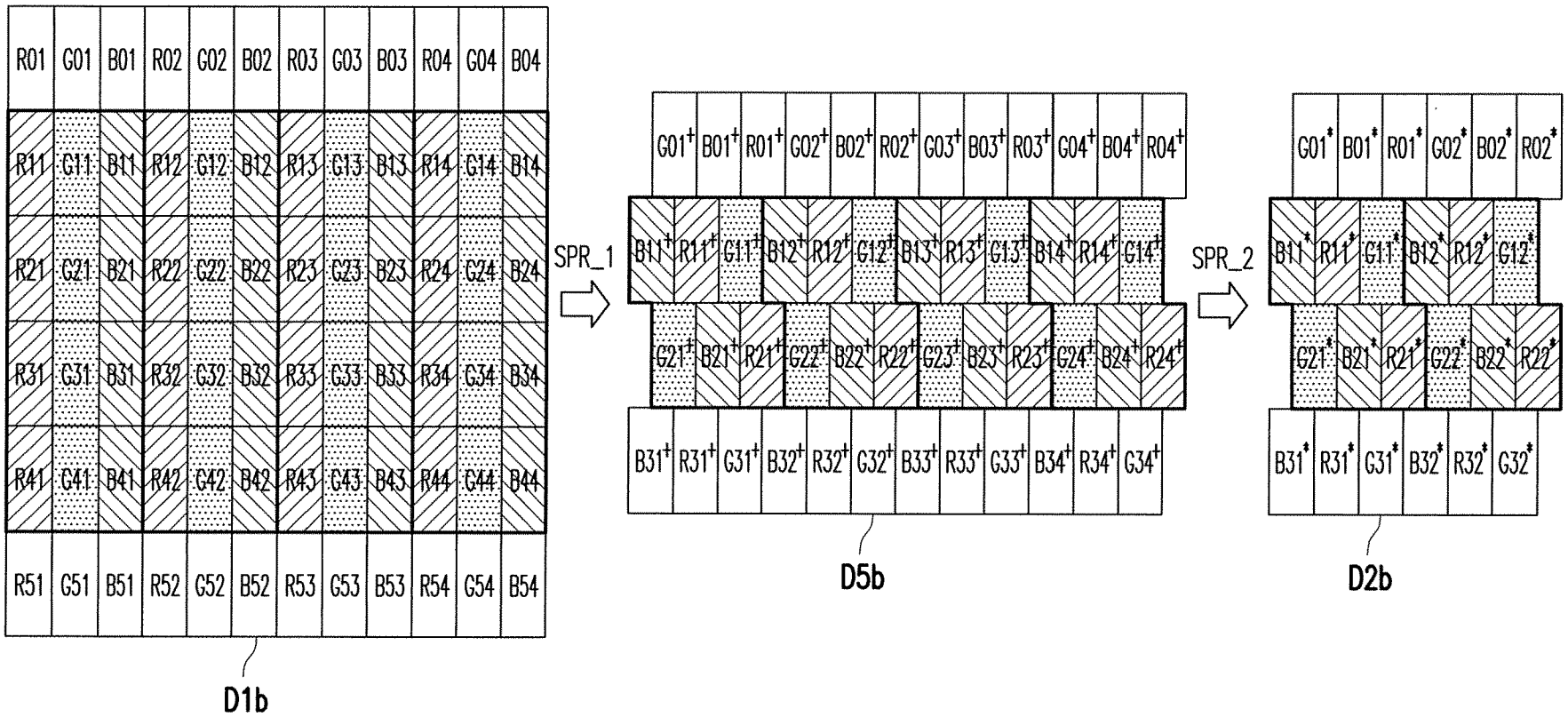
FIG. 13 and FIG. 14 are schematic diagrams of two-dimensional subpixel rendering operations in different embodiments of the invention.
Figure 14:
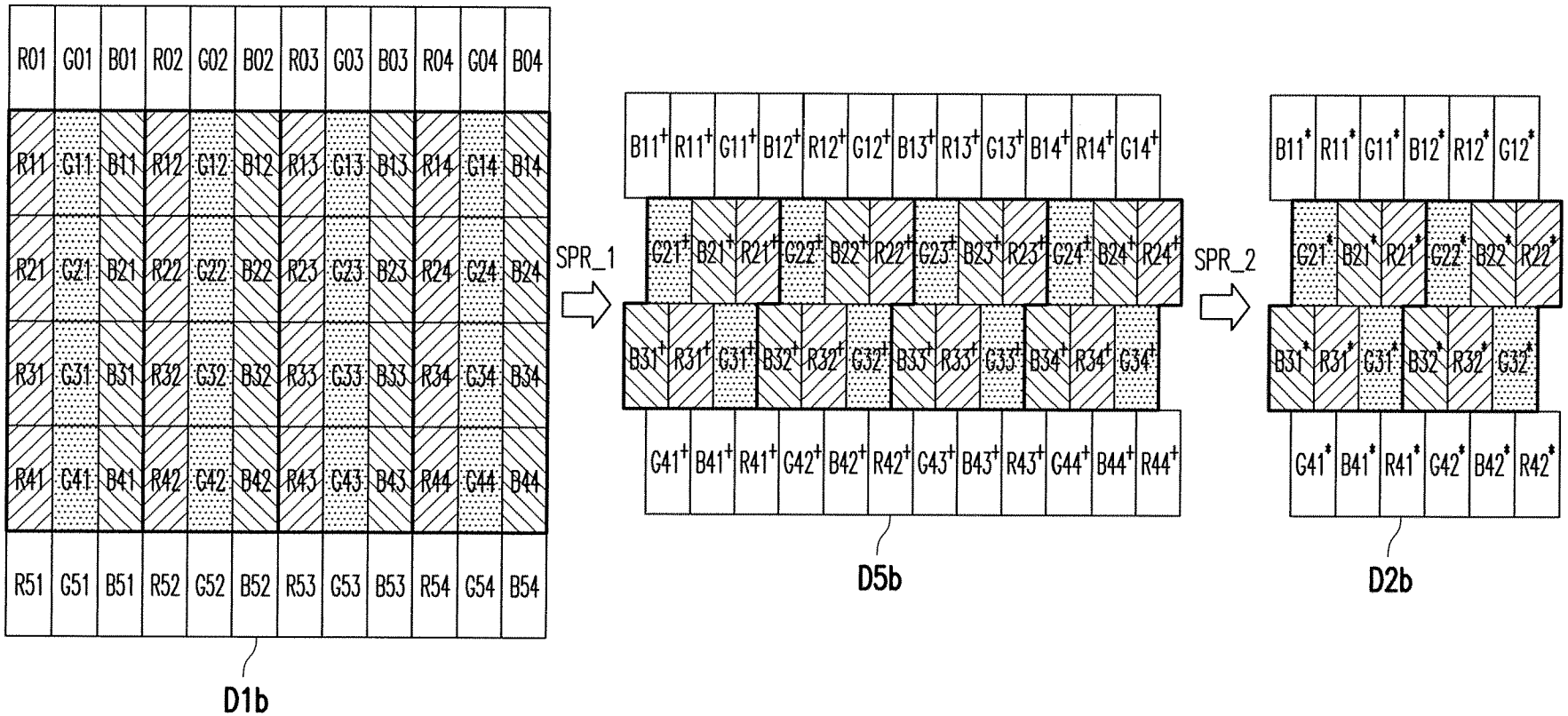

FIG. 13 and FIG. 14 are schematic diagrams of two-dimensional subpixel rendering operations in different embodiments of the invention. With reference to FIG. 13 and FIG. 14, both subpixel sampling rates of SPR_1 and SPR_2 in the two-dimensional subpixel rendering operations in the embodiments of FIG. 13 and FIG. 14 are 1/2. In FIG. 13 and FIG. 14, arrangements of the pixel data and the subpixel data in the first image data D1*b*, the second image data D2*b* and the fifth image data D5*b* are corresponding to pixels and subpixels in the display panel. In FIG. 13 and FIG. 14, an arrangement of the subpixels in the display panels driven by the display drivers 120 and 320 is the same type of RGB stripe arrangement, or colors of starting subpixels from each display line in the display panel are different. The difference between FIG. 13 and FIG. 14 is that, the first one-dimensional subpixel rendering operations SPR_1 in the pixel column direction in the two embodiments generate the fifth image data D5*b* according to the different combinations of subpixel data, and the second one-dimensional subpixel rendering operations SPR_2 in the pixel row direction in the two embodiments also generate the second image data D2*b* according to the different combinations of subpixel data.

In addition, sufficient teaching, suggestion, and implementation regarding the method for generating the display data of the display panel in the embodiments of FIG. 11 to FIG. 14 may be obtained from the foregoing embodiments of FIG. 9 to FIG. 10, and thus related descriptions thereof are not repeated hereinafter.

Image data generated by the two-dimensional subpixel rendering operation according to the exemplary embodiments of FIG. 9 to FIG. 14 are, for example, written into the liquid crystal display panel. In an embodiment, the image data generated by the two-dimensional subpixel rendering operation may also be written into the organic light-emitting diode panel.

Figure 15:
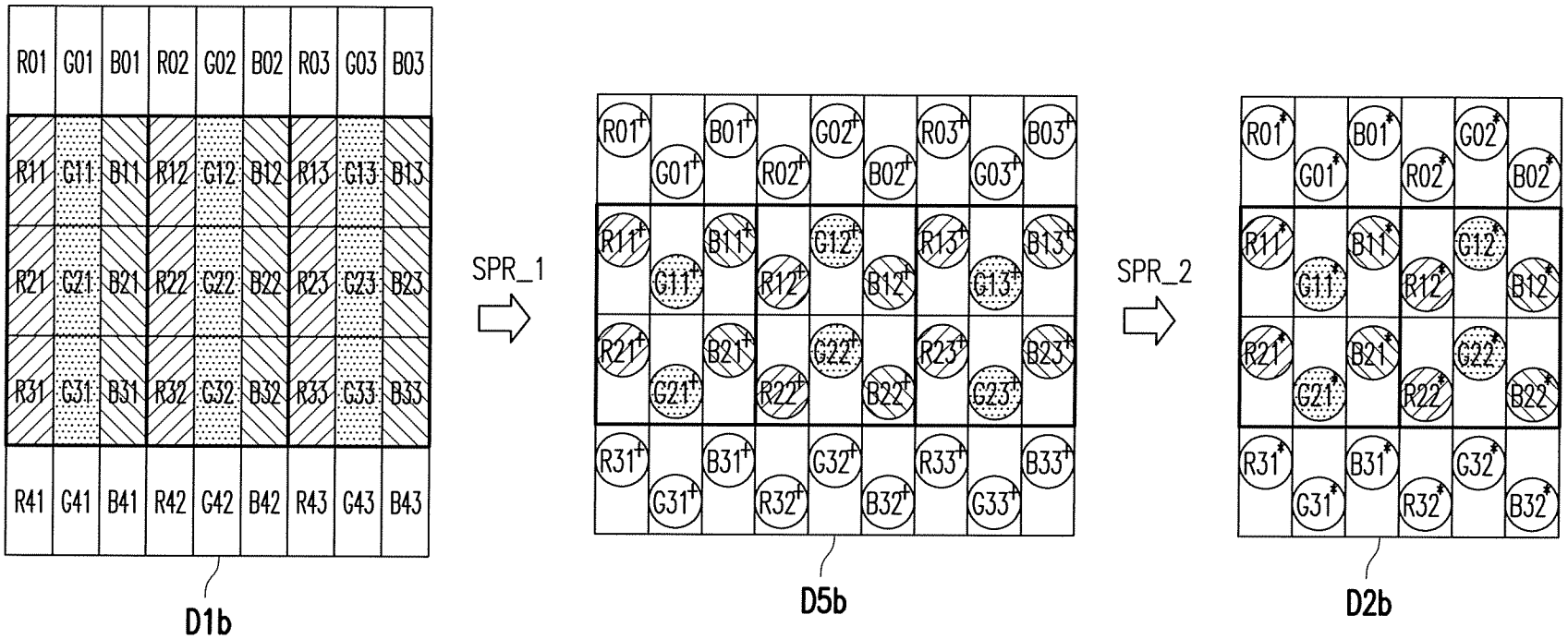
FIG. 15 and FIG. 16 are schematic diagrams of two-dimensional subpixel rendering operations in different embodiments of the invention.
Figure 16:
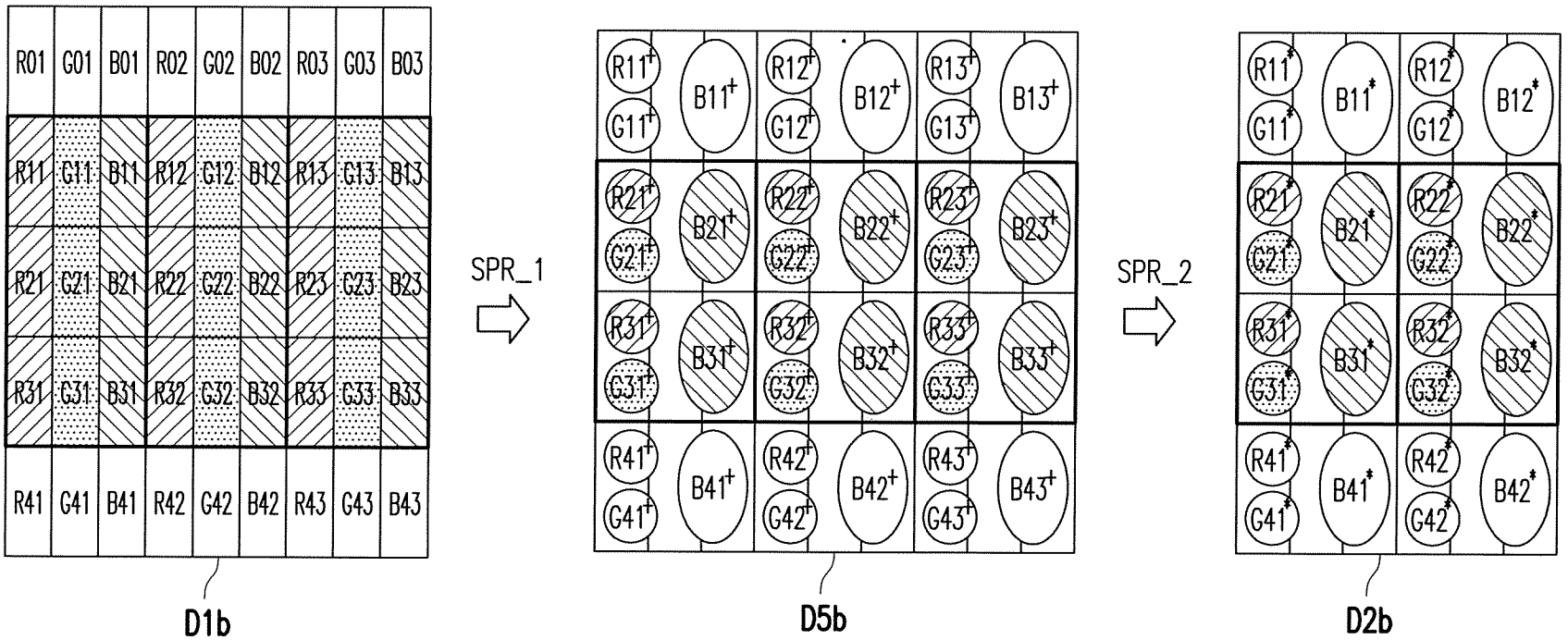

FIG. 15 and FIG. 16 are schematic diagrams of two-dimensional subpixel rendering operations in different embodiments of the invention. In FIG. 15, an arrangement of the subpixels in the organic light-emitting diode panel driven by the display drivers 120 and 320 is, for example, a first-type arrangement. In FIG. 16, an arrangement of the subpixels in the organic light-emitting diode panel driven by the display drivers 120 and 320 is, for example, a second-type arrangement. Both subpixel sampling rates of SPR_1 and SPR_2 in the two-dimensional subpixel rendering operations in the embodiments of FIG. 15 and FIG. 16 are 2/3. In FIG. 15 and FIG. 16, arrangements of the pixel data and the subpixel data in the first image data D1*b*, the second image data D2*b* and the fifth image data D5*b* are corresponding to pixels and subpixels in the display panel.

In addition, sufficient teaching, suggestion, and implementation regarding the method for generating the display data of the display panel in the embodiments of FIG. 15 to FIG. 16 may be obtained from the foregoing embodiments of FIG. 9 to FIG. 14, and thus related descriptions thereof are not repeated hereinafter.

In an exemplary embodiment of the invention, the image data processor unit 122 performs, for example, the first one-dimensional subpixel rendering operation SPR_1 in the pixel data columns of the first image data D1*b* first, and then performs the second one-dimensional subpixel rendering operation SPR_2 in the pixel data rows of the fifth image data D5*b*. Alternatively, the image data processor unit 122 may also perform the second one-dimensional subpixel rendering operation SPR_2 in the pixel data rows of the first image data D1*b* first, and then perform the first one-dimensional subpixel rendering operation SPR_1 in the pixel data columns of the fifth image data D5*b*. In an embodiment, the image data processor unit 122 may also perform the two-dimensional subpixel rendering operation on the first image data D1*b* by a pixel data array having a total of m*n pixel data as a basis unit rather than performing the one-dimensional subpixel rendering operation in different directions. Here, m is the number of pixel data of the pixel row direction in the pixel data array, and n is the number of pixel data of the pixel column direction in the pixel data array.

Figure 17:
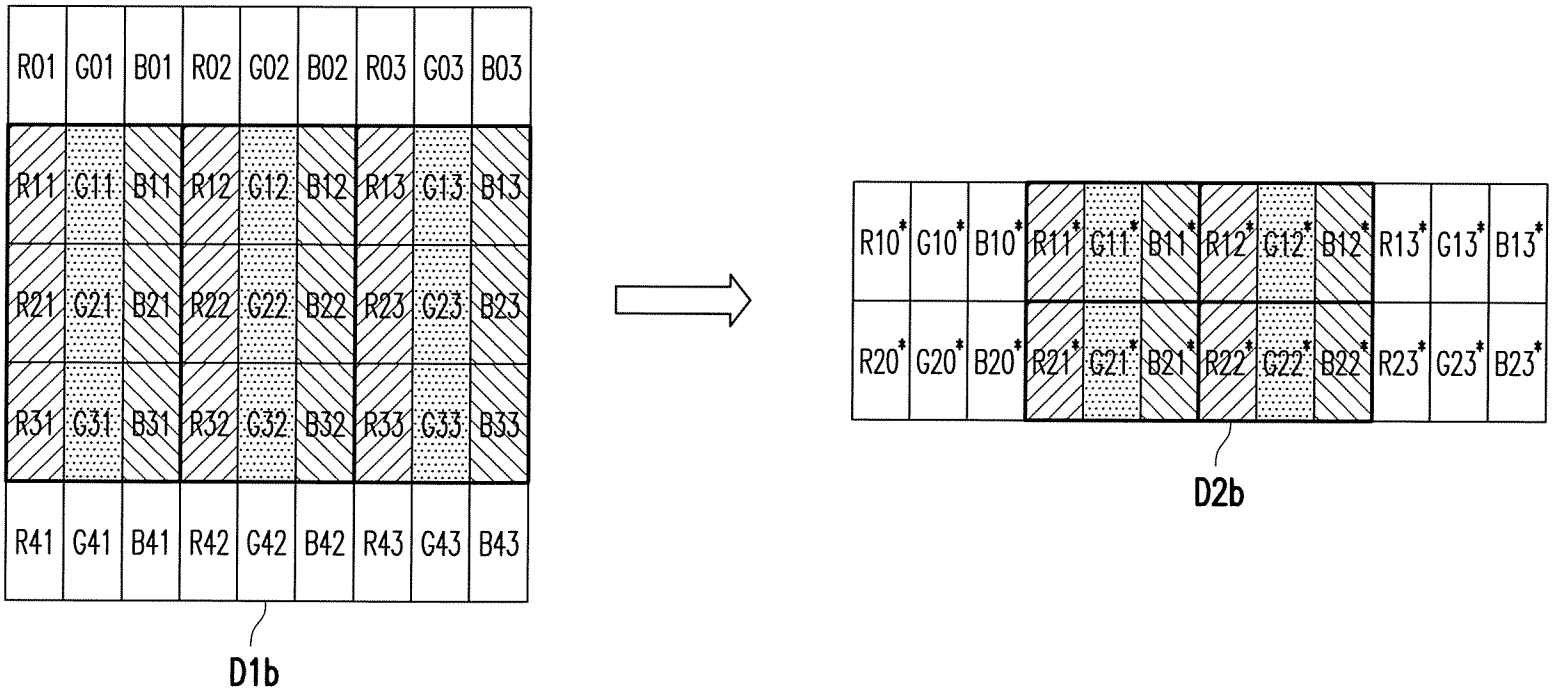
FIG. 17 is a schematic diagram illustrating a two-dimensional subpixel rendering operation in an embodiment of the invention.

FIG. 17 is a schematic diagram illustrating a two-dimensional subpixel rendering operation in an embodiment of the invention. With reference to FIG. 17, in the present embodiment, the image data processor unit 122 performs the two-dimensional subpixel rendering operation on the first image data D1*b* to generate the second image data D2*b* based on a pixel data array having a total of 3*3 pixel data. In other words, the two-dimensional subpixel rendering operation of the present embodiment is performed based on the pixel column direction and the pixel row direction. However, the image data processor unit 122 does not divide the first image data D1*b* into the pixel data columns or the pixel data rows and perform the one-dimensional subpixel rendering operation twice in different directions. In addition, sufficient teaching, suggestion, and implementation regarding the method for generating the display data of the display panel in the embodiment of FIG. 17 may be obtained from the foregoing embodiments of FIG. 9 to FIG. 16, and thus related descriptions thereof are not repeated hereinafter.

Figure 18:
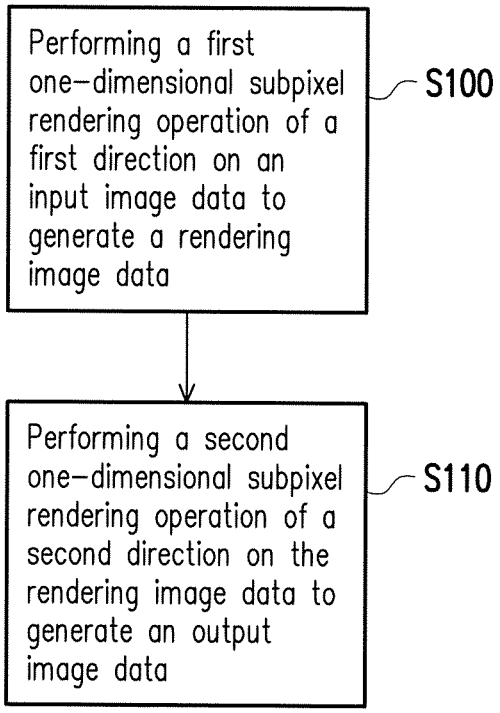
FIG. 18 is a flowchart illustrating a method for generating a display data of a display panel in an embodiment of the invention.

FIG. 18 is a flowchart illustrating a method for generating a display data of a display panel in an embodiment of the invention. The method for generating the display data of the present embodiment is at least adapted to the display apparatus 100 of FIG. 1 or the electronic apparatus 300 of FIG. 5. Taking the display apparatus 100 of FIG. 1 for example, in step S100, the display driver 120 performs the first one-dimensional subpixel rendering operation SPR_1 in a first direction on the input image data VIN to generate a rendered image data. In step S110, the display driver 120 performs the second one-dimensional subpixel rendering operation SPR_2 in a second direction on the rendered image data to generate the output image data VOUT. In an embodiment, the first direction is the pixel column direction and the second direction is the pixel row direction. In another embodiment, the first direction is the pixel row direction and the second direction is the pixel column direction. In addition, sufficient teaching, suggestion, and implementation regarding the method for generating the display data of the display panel in the embodiment of FIG. 18 may be obtained from the foregoing embodiments of FIG. 9 to FIG. 17, and thus related descriptions thereof are not repeated hereinafter.

In summary, according to the exemplary embodiments of the invention, in the display driver and the method for generating the display data of the display panel, the display processing includes the two-dimensional subpixel rendering operation. With the two-dimensional subpixel rendering operation performed by the image data processor unit on the input image data to generate the output image data, the size of the data buffer required for storing the data in the device may be reduced, or the data transmission amount of the image data in the device or between devices (i.e., between the image data transmitter and the image data receiver) may be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display driver, adapted to drive a display panel, wherein the display panel comprises a pixel column direction and a pixel row direction, and the display driver comprises:

an image data processor unit, configured to perform a two-dimensional subpixel rendering operation on an input image data to generate an output image data, wherein the display driver drives the display panel according to the output image data, wherein the two-dimensional subpixel rendering operation comprises a first one-dimensional subpixel rendering operation in a first direction and a second one-dimensional subpixel rendering operation in a second direction, wherein the first direction is one of the pixel column direction and the pixel row direction, and the second direction is another one of the pixel column direction and the pixel row direction, wherein the image data processor unit sequentially performs the first one-dimensional subpixel rendering operation and the second one-dimensional subpixel rendering operation on the input image data, and the data amount of the output image data is smaller than the data amount of the input image data.

2. The display driver according to claim 1, wherein the two-dimensional subpixel rendering operation comprises performing the first one-dimensional subpixel rendering operation in the first direction on the input image data to generate a rendered image data, and performing the second one-dimensional subpixel rendering operation in the second direction on the rendered image data to generate the output image data.

3. The display driver according to claim 2, wherein the first one-dimensional subpixel rendering operation comprises computing a subpixel data in a pixel data and at least one adjacent subpixel data in the first direction with identical color in the input image data according to a first set of diffusion ratios, so as to generate a subpixel data in a rendered pixel data in the rendered image data.

4. The display driver according to claim 3, wherein the second one-dimensional subpixel rendering operation comprises computing the subpixel data in the rendered pixel data and at least one adjacent subpixel data in the second direction with identical color in the rendered image data according to a second set of diffusion ratios, so as to generate a subpixel data in an output pixel data in the output image data.

5. The display driver according to claim 3, wherein when a subpixel sampling rate of the first one-dimensional subpixel rendering operation is 2/3 and the first direction is the pixel column direction, with respect to a first pixel data corresponding to a middle row among three consecutive pixel data of the pixel column direction in the input image data, a first color subpixel data in the first pixel data is assigned as a first color component of a first rendered pixel data among two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

6. The display driver according to claim 3, wherein when a subpixel sampling rate of the first one-dimensional subpixel rendering operation is 1/2 and the first direction is the pixel column direction, with respect to a first pixel data among two consecutive pixel data of the pixel column direction in the input image data, a first color subpixel data in the first pixel data is assigned as a first color component of a first rendered pixel data among the two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

7. A method for generating a display data of a display panel, comprising:

performing a first one-dimensional subpixel rendering operation in a first direction on an input image data to generate a rendered image data; and performing a second one-dimensional subpixel rendering operation in a second direction on the rendered image data to generate an output image data, wherein the output image data is used for driving the display panel comprising a pixel column direction and a pixel row direction, wherein the first direction is one of the pixel column direction of the display panel and the pixel row direction of the display panel and the second direction is another one of the pixel column direction of the display panel and the pixel row direction of the display panel, wherein the data amount of the rendered image data is smaller than the data amount of the input image data, and the data amount of the output image data is smaller than the data amount of the rendered image data.

8. The method for generating the display data according to claim 7, wherein the first one-dimensional subpixel rendering operation comprises computing a subpixel data in a pixel data and at least one adjacent subpixel data in the first direction with identical color in the input image data according to a first set of diffusion ratios, so as to generate a subpixel data in a rendered pixel data in the rendered image data.

9. The method for generating the display data according to claim 8, wherein the second one-dimensional subpixel rendering operation comprises computing the subpixel data in the rendered pixel data and at least one adjacent subpixel data in the second direction with identical color in the rendered image data according to a second set of diffusion ratios, so as to generate a subpixel data in an output pixel data in the output image data.

10. The method for generating the display data according to claim 8, wherein when a subpixel sampling rate of the first one-dimensional subpixel rendering operation is 2/3 and the first direction is the pixel column direction, with respect to a first pixel data corresponding to a middle row among three consecutive pixel data of the pixel column direction in the input image data, a first color subpixel data in the first pixel data is assigned as a first color component of a first rendered pixel data among two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

11. The method for generating the display data according to claim 8, wherein when a subpixel sampling rate of the first one-dimensional subpixel rendering operation is 1/2 and the first direction is the pixel column direction, with respect to a first pixel data among two consecutive pixel data of the pixel column direction in the input image data, a first color subpixel data in the first pixel data is assigned as a first color component of a first rendered pixel data among the two consecutive rendered pixel data of the pixel column direction in the rendered image data according to a first color diffusion ratio, and a second color subpixel data in the first pixel data is assigned as a second color component of a second rendered pixel data among the two consecutive rendered pixel data according to a second color diffusion ratio.

12. An electronic apparatus, comprising:

a display panel, comprising a pixel column direction and a pixel row direction, an image data processor unit, configured to perform a two-dimensional subpixel rendering operation on a first image data to generate a second image data;

an image compression unit, configured to compress the second image data to generate a third image data;

a storage unit, configured to receive and store the third image data; and an image decompression unit, configured to decompress the third image data to generate a fourth image data, wherein the display panel is driven according to the fourth image data, wherein the two-dimensional subpixel rendering operation comprises a first one-dimensional subpixel rendering operation in a first direction and a second one-dimensional subpixel rendering operation in a second direction, wherein the first direction is one of the pixel column direction and the pixel row direction, and the second direction is another one of the pixel column direction and the pixel row direction, wherein the image data processor unit sequentially performs the first one-dimensional subpixel rendering operation and the second one-dimensional subpixel rendering operation on the first image data, and the data amount of the second image data is smaller than the data amount of the first image data.

13. The electronic apparatus according to claim 12, wherein the two-dimensional subpixel rendering operation comprises performing the first one-dimensional subpixel rendering operation in the first direction on the first image data to generate a fifth image data, and performing the second one-dimensional subpixel rendering operation in the second direction on the fifth image data to generate the second image data.

14. The electronic apparatus according to claim 13, wherein the first one-dimensional subpixel rendering operation comprises computing a subpixel data in a pixel data and at least one adjacent subpixel data in the first direction with identical color in the first image data according to a first set of diffusion ratios, so as to generate a subpixel data in a rendered pixel data in the fifth image data.

15. The electronic apparatus according to claim 14, wherein the second one-dimensional subpixel rendering operation comprises computing the subpixel data in the rendered pixel data and at least one adjacent subpixel data in the second direction with identical color in the fifth image data according to a second set of diffusion ratios, so as to generate a subpixel data in a rendered pixel data in the second image data.

16. The electronic apparatus according to claim 14, wherein when a subpixel sampling rate of the first one-dimensional subpixel rendering operation is 2/3 and the first direction is the pixel column direction, with respect to a first pixel data corresponding to a middle row among three consecutive pixel data of the pixel column direction in the first image data, a first color subpixel data in the first pixel data is assigned as a first color component of a first rendered pixel data among two consecutive rendered pixel data of the pixel column direction in the fifth image data according to a first color diffusion ratio, and a second color subpixel data in the first pixel data is assigned as a second color component of a second rendered pixel data among the two consecutive rendered pixel data according to a second color diffusion ratio.

17. The electronic apparatus according to claim 14, wherein when a subpixel sampling rate of the first one-dimensional subpixel rendering operation is 1/2 and the first direction is the pixel column direction, with respect to a first pixel data among two consecutive pixel data of the pixel column direction in the first image data, a first color subpixel data in the first pixel data is assigned as a first color component of a first rendered pixel data among two consecutive rendered pixel data of the pixel column direction in the fifth image data according to a first color diffusion ratio, and a second color subpixel data in the first pixel data is assigned as a second color component of a second rendered pixel data among the two consecutive rendered pixel data according to a second color diffusion ratio.

18. The electronic apparatus according to claim 12, wherein the image data processor unit, the image compression unit, the storage unit and the image decompression unit are disposed in a display driver of the electronic apparatus, and the display driver is coupled to the display panel and configured to drive the display panel according to the fourth image data.

19. The electronic apparatus according to claim 18, wherein the display driver further comprises:

a first subpixel rendering inverse operation unit, configured to perform a two-dimensional subpixel rendering inverse operation on the second image data to generate a first inverse image data; and a first computation unit, configured to calculate a difference between the first image data and the first inverse image data.

20. The electronic apparatus according to claim 19, wherein the image compression unit performs a data compression on a difference between the first image data and the first inverse image data to generate an image error data to be outputted to the storage unit.

21. The electronic apparatus according to claim 20, wherein the storage unit is further configured to receive and store the image error data, and the image decompression unit decompresses the image error data to generate a sixth image data.

22. The electronic apparatus according to claim 21, wherein the display driver further comprises:

a second subpixel rendering inverse operation unit, configured to perform the two-dimensional subpixel rendering inverse operation on the fourth image data to generate a second inverse image data; and a second computation unit, configured to combine the sixth image data and the second inverse image data to generate a seventh image data, wherein the display driver drives the display panel according to the seventh image data.

23. The electronic apparatus according to claim 12, wherein the image data processor unit and the image compression unit are disposed in a processor of the electronic apparatus, and the storage unit and the image decompression unit are disposed in a display driver of the electronic apparatus, wherein the display driver is coupled to the processor and the display panel and configured to receive the third image data from the processor and drive the display panel according to the fourth image data.

24. The electronic apparatus according to claim 23, wherein the processor further comprises:

a first subpixel rendering inverse operation unit, configured to perform a two-dimensional subpixel rendering inverse operation on the second image data to generate a first inverse image data; and a first computation unit, configured to calculate a difference between the first image data and the first inverse image data.

25. The electronic apparatus according to claim 24, wherein the image compression unit of the processor performs a data compression on the difference between the first image data and the first inverse image data to generate an image error data to be outputted to the storage unit of the display driver.

26. The electronic apparatus according to claim 25, wherein the storage unit of the display driver is further configured to receive and store the image error data, and the image decompression unit of the display driver decompresses the image error data to generate a sixth image data.

27. The electronic apparatus according to claim 26, wherein the display driver further comprises:

a second subpixel rendering inverse operation unit, configured to perform the two-dimensional subpixel rendering inverse operation on the fourth image data to generate a second inverse image data; and a second computation unit, configured to combine the sixth image data and the second inverse image data to generate a seventh image data, wherein the display driver drives the display panel according to the seventh image data.

* * * * *